US008784206B1

(12) United States Patent
Gronkowski et al.

(10) Patent No.: US 8,784,206 B1
(45) Date of Patent: Jul. 22, 2014

(54) MODIFYING PRESENTATION OF THREE-DIMENSIONAL, WAGERING-GAME CONTENT

(75) Inventors: Timothy T. Gronkowski, Chicago, IL (US); John F. LaSalvia, Las Vegas, NV (US); Timothy C. Loose, Chicago, IL (US); Scott A. Massing, Lincolnwood, IL (US); Craig J. Sylla, Round Lake, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/447,210

(22) Filed: Apr. 14, 2012

Related U.S. Application Data

(60) Provisional application No. 61/476,070, filed on Apr. 15, 2011.

(51) Int. Cl.
*A63F 9/24* (2006.01)

(52) U.S. Cl.
USPC ..... 463/32

(58) Field of Classification Search
CPC ..... G07F 17/3202; G07F 17/3206; G07F 17/3211; G07F 17/3213; B60N 2002/0272; B60N 2002/0268; A63F 2300/8082; G06T 2207/10021; G06T 7/0075; G06T 17/00; H04N 13/0468
USPC ..... 463/32
See application file for complete search history.

(56) References Cited

U.S. PATENT DOCUMENTS

| | | | |
|---|---|---|---|
| 4,371,164 | A | 2/1983 | Halliburton |
| 5,287,437 | A | 2/1994 | Deering |
| 6,504,649 | B1 | 1/2003 | Myers |
| 6,842,183 | B2 | 1/2005 | Higashiyama et al. |
| 6,863,609 | B2 | 3/2005 | Okuda et al. |
| 6,866,585 | B2 | 3/2005 | Muir |
| 6,887,157 | B2 | 5/2005 | LeMay et al. |
| 7,128,647 | B2 | 10/2006 | Muir |
| 7,278,920 | B1 | 10/2007 | Klamer et al. |
| 7,311,607 | B2 | 12/2007 | Tedsen et al. |
| 7,465,230 | B2 | 12/2008 | LeMay et al. |
| 7,572,186 | B2 | 8/2009 | LeMay et al. |

(Continued)

FOREIGN PATENT DOCUMENTS

| | | |
|---|---|---|
| EP | 1180384 | 2/2002 |
| EP | 1221817 A1 * | 7/2002 |

(Continued)

OTHER PUBLICATIONS

"U.S. Appl. No. 13/295,040 Office Action", Dec. 20, 2012, 28 pages.

*Primary Examiner* — Steve Rowland
(74) *Attorney, Agent, or Firm* — DeLizio Gilliam, PLLC

(57) ABSTRACT

A wagering game system and its operations are described herein. In some embodiments, the operations can include presenting a three-dimensional image of wagering game content via a display associated with a wagering game machine. The operations can further include estimating a degree of alteration to a stereoscopic view of the three-dimensional image caused by a change in the position of a device (e.g., a chair) connected to the wagering game machine. The operations can further include altering a presentation of the three-dimensional image based on the degree of alteration to the stereoscopic view of the three-dimensional image caused by the change in the position of the device.

25 Claims, 11 Drawing Sheets

(56) References Cited

U.S. PATENT DOCUMENTS

| | | | | |
|---|---|---|---|---|
| 7,775,876 | B2 | 8/2010 | Rowe | |
| 7,841,944 | B2 | 11/2010 | Wells | |
| 7,857,700 | B2 | 12/2010 | Wilder et al. | |
| 7,901,289 | B2 | 3/2011 | Schlottmann et al. | |
| 7,934,994 | B2 | 5/2011 | LeMay et al. | |
| 7,951,001 | B2 | 5/2011 | Wells | |
| 8,002,623 | B2 | 8/2011 | Resnick et al. | |
| 8,079,905 | B2 | 12/2011 | Nguyen et al. | |
| 8,159,526 | B2 | 4/2012 | Sato et al. | |
| 8,269,822 | B2 | 9/2012 | Zalewski | |
| 2002/0003537 | A1 | 1/2002 | Higashiyama et al. | |
| 2002/0022518 | A1 | 2/2002 | Okuda et al. | |
| 2002/0067466 | A1* | 6/2002 | Covannon et al. | 353/8 |
| 2003/0032479 | A1 | 2/2003 | LeMay et al. | |
| 2004/0192430 | A1* | 9/2004 | Burak et al. | 463/20 |
| 2004/0198505 | A1 | 10/2004 | Hatakeda | |
| 2004/0214630 | A1 | 10/2004 | Mayeroff | |
| 2005/0059479 | A1 | 3/2005 | Soltys et al. | |
| 2005/0233799 | A1 | 10/2005 | LeMay et al. | |
| 2006/0014577 | A1 | 1/2006 | Snow | |
| 2006/0061652 | A1 | 3/2006 | Sato et al. | |
| 2006/0095410 | A1 | 5/2006 | Ostrover et al. | |
| 2006/0287058 | A1 | 12/2006 | Resnick | |
| 2007/0281780 | A1 | 12/2007 | Aida | |
| 2008/0015004 | A1 | 1/2008 | Gatto et al. | |
| 2008/0024597 | A1 | 1/2008 | Yang et al. | |
| 2008/0045331 | A1 | 2/2008 | LeMay et al. | |
| 2008/0108426 | A1 | 5/2008 | Nguyen et al. | |
| 2008/0113745 | A1 | 5/2008 | Williams et al. | |
| 2008/0113775 | A1 | 5/2008 | Williams et al. | |
| 2008/0125219 | A1 | 5/2008 | Williams et al. | |
| 2008/0194320 | A1 | 8/2008 | Walsh et al. | |
| 2008/0303746 | A1 | 12/2008 | Schlottmann et al. | |
| 2009/0036196 | A1 | 2/2009 | Ansari et al. | |
| 2009/0062001 | A1 | 3/2009 | LeMay et al. | |
| 2009/0201362 | A1* | 8/2009 | Shestak et al. | 348/56 |
| 2009/0227371 | A1 | 9/2009 | Visser | |
| 2009/0291731 | A1 | 11/2009 | Jaffe et al. | |
| 2010/0007582 | A1 | 1/2010 | Zalewski | |
| 2010/0029361 | A1 | 2/2010 | Anderson et al. | |
| 2010/0279755 | A1 | 11/2010 | Pacey et al. | |
| 2011/0018867 | A1 | 1/2011 | Shibamiya et al. | |
| 2011/0018868 | A1 | 1/2011 | Inoue et al. | |
| 2011/0045981 | A1 | 2/2011 | Ansari et al. | |
| 2011/0053675 | A1 | 3/2011 | Aoki et al. | |
| 2011/0201404 | A1 | 8/2011 | Wells | |
| 2011/0255019 | A1 | 10/2011 | Son | |
| 2012/0190439 | A1 | 7/2012 | Nourbakhsh | |
| 2012/0194656 | A1 | 8/2012 | Killian | |

FOREIGN PATENT DOCUMENTS

| | | |
|---|---|---|
| KR | 1020020013751 | 2/2002 |
| WO | WO 2005034054 | 4/2005 |
| WO | WO 2007146264 | 12/2007 |
| WO | WO 2008060517 | 5/2008 |
| WO | WO2008061068 | 5/2008 |
| WO | WO 2008063914 | 5/2008 |
| WO | WO 2008063968 | 5/2008 |
| WO | WO 2008079542 | 7/2008 |
| WO | WO 2008097577 | 8/2008 |
| WO | WO 2008154433 | 12/2008 |
| WO | WO 2009009224 | 1/2009 |
| WO | WO 2009009225 | 1/2009 |
| WO | WO 2009029720 | 3/2009 |
| WO | WO 2009061489 | 5/2009 |
| WO | WO 2011142399 | 11/2011 |

* cited by examiner

MODIFYING PRESENTATION OF THREE-DIMENSIONAL, WAGERING-GAME CONTENT

RELATED APPLICATIONS

This application claims the priority benefit of U.S. Provisional Application Ser. No. 61/476,070 filed Apr. 15, 2011.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2012, WMS Gaming, Inc.

TECHNICAL FIELD

Embodiments of the inventive subject matter relate generally to wagering game systems and networks that, more particularly, present three-dimensional, wagering-game content.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play. Furthermore, three-dimensional (3D) presentation technologies have captivated the interest of the entertainment industry for years. The gaming industry can also benefit from 3D presentation technologies in innovative ways.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into five sections. The first section provides an introduction to embodiments. The second section describes example operations while the third section describes additional example embodiments. The fourth section describes example operating environments while the fifth section presents general comments.

Introduction

This section provides an introduction to some embodiments.

Wagering games are expanding in popularity. Wagering game enthusiasts expect continuous innovations to the wagering game experience. As stated previously, wagering game companies are interested in creating and providing innovate wagering games and gaming features to the demanding public, including utilizing 3D presentation technologies from 3D displays (e.g., display devices capable of conveying a stereoscopic perception of 3D depth to an observer, such as via presentation of offset images that are displayed separately to the left and right eye). Some embodiments of the present inventive subject matter modify a 3D presentation of wagering game content according to changes of an observer's perspective.

Figures 1A, 1B:
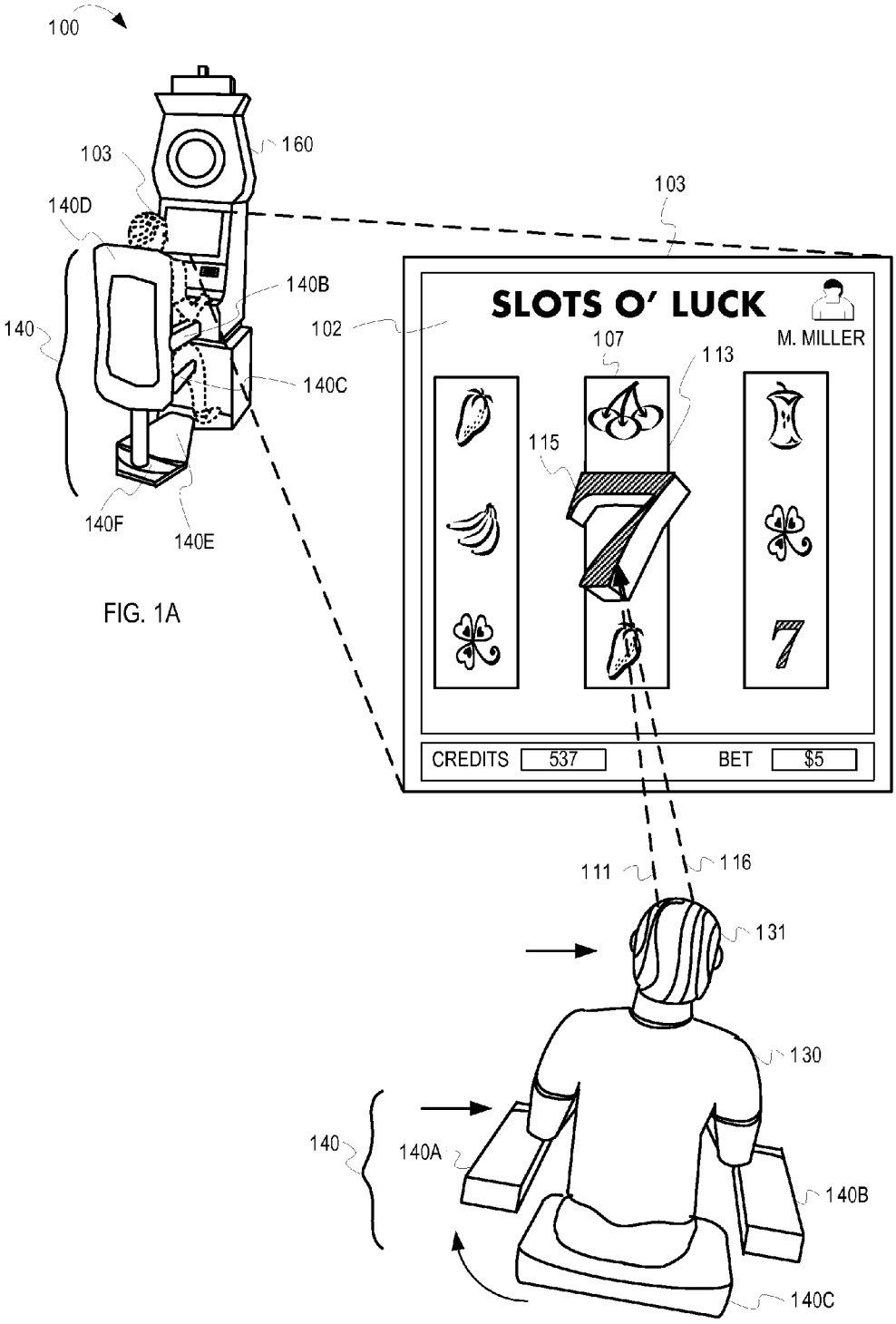
FIGS. 1A-1B are illustrations of modifying a three-dimensional image of wagering game content in response to a change in viewing perspective, according to some embodiments.

FIGS. 1A and 1B are illustrations of modifying a three-dimensional image of wagering game content in response to a change in viewing perspective, according to some embodiments. In FIGS. 1A and 1B, a wagering game system ("system") 100 includes a wagering game machine 160. In some embodiments, the system 100 may further include additional elements, such as a wagering game server, an account server, a web server, a personal computer, a mobile device, etc. connected via a communications network. The wagering game machine 160 can include various elements, such as a three-dimensional display ("display") 103, a chair 140, input devices (e.g., buttons, card readers, player controls, etc.), peripheral devices (e.g., additional displays), speakers, emotive lighting devices, a top-box, etc. The wagering game machine 160 can present wagering game content (e.g., wagering game 102) via the display 103. The wagering game 102 is a wagering game application that is controlled by the wagering game machine 160 and/or a wagering game server. For example, the wagering game 102 may be a wagering game application installed and stored on memory of the wagering game machine 160. The wagering game machine 160 may further present secondary wagering games, such as server-side applications controlled by a wagering game server, as well as the wagering game machine 160 as a thin client, via a communications network. The wagering game machine 160 may include several controls, such as a reel-spin control, betting controls, controls for setting a number of pay lines, and a 3D toggle control to toggle 3D presentations on and off for elements presented on the display 103, etc. The display 103 further presents information about, or associated with, gambling and/or a player account that provides information and funds for gambling, such as a credit meter, a bet meter, player profile information, etc. The wagering game 102 includes specific wagering game elements, such as reel element 115 (e.g. a graphical image of the number "7"). In some embodiments, some, or all, of the elements, such as reel element 115, are presented in 3D via use of the display 103. The display 103 is configured to present content using 3D presentation technologies that present content with a stereoscopic effect (e.g., presentation of two slightly offset, separate views of an object, which, when observed by separate eyes of the observer, cause the object to appear to have depth, width, and height). For instance, the system 100 presents the reel element 115 using stereoscopic presentation, which causes the reel element 115 to appears to hover in front of the display 103 with a stereoscopic effect, extending beyond a boundary 113 of a reel 107. An observer of the 3D image on the display 103, such as a wagering game player ("player") 130 may sit in the chair 140, which is connected to the wagering game machine 160. The chair 140 may include various elements, such as armrests 140A, 140B, a seat 140C, a back 140D, a base 140E, and a track 140F. In the base 140E are connective mechanisms that relay information (e.g., sound content, electrical signals, etc.) between the chair 140 and other elements of the wagering game machine 160. The track 140F moves the chair 140 automatically (e.g., side-to-side, or laterally), such as in response to events or triggers from the wagering game 102, in response to manual input from the player 130 seated at the chair 140 (e.g., in response to body lean, head or eye movement, input from player input devices or controls, etc.) or in response to any machine-generated input or output (e.g., in response to output from any application running on the wagering game machine 160, in response to communications sent to the wagering game machine 160, in response to environmental stimuli or signals, etc.). The chair 140 is further configured, in some embodiments, to tilt, rotate, and move in any ways, such as to emulate movement of an airplane, a boat, a vehicle, etc. FIG. 1A shows the chair 140 with an occupant in dashed lines to highlight the chair 140 and wagering game machine 160. FIG. 1B shows the chair 140 from behind, with the back 140D removed, to illustrate a position of an occupant. The chair 140 and the player 130 may move during the course of a wagering game session, while the reel element 115 is presented on the display 103. The movement by the chair 140, and subsequently the player 130, may cause the head 131, and hence the eyes, of the player 130 to move, or change position relative to the display 103. As a result, a stereoscopic effect presented by the display 103 of the reel element 115 may possibly be altered (e.g., become degraded) because of the position of the player's eyes after the chair 140, and ultimately the position of the eyes of the player 130, have moved. In other words, the display 103 may present a view of the reel element 115 that is optimized to a first position of the player's eyes that view the reel element 115 at a first viewing perspective 111. When the position of the player 130 shifts to the right, the head 131 moves to the right, as well as the eyes, to a second position, associated with a second viewing perspective 116. Because of the change from the first viewing perspective 111 to the second viewing perspective 116, the view of the reel element 115 from the second viewing perspective 116 would no longer be optimized, and some stereoscopic effects of the reel element 115 may become degraded (e.g., lost, blurred, dim, etc.). Consequently, the system 100 can modify the 3D presentation of the reel element 115 to adjust to the change in position of the player 130 effectuated by the chair 140. For instance, as the position of the player 130 moves laterally, a degree of parallax associated with a perspective of the player 130 changes and the system 100 adjusts the presentation of the reel element 115 with a counterbalancing degree of parallax shift, or compensation. Thus, the image of the reel element 115 can maintain a consistent (e.g., substantially approximate or equivalent) degree of parallax effect with a consistent degree of 3D quality (e.g., with minimal loss of luminosity, with minimal distortion, etc.) in response to changes in viewing perspective. Thus system 100, therefore, adjusts for changes in parallax (displacement, or difference, in an apparent position of an object viewed along two different lines of sight, such as the lines of sight for each of the eyes of the player 130), when the position of the player 130 shifts during a wagering game session, such as because of game play triggers that cause the chair 140 to move.

Further, some embodiments of the inventive subject matter can utilize a network wagering venue (e.g., an online casino, a wagering game website, a wagering network, etc.) using a communication network. Embodiments can be presented over any type of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Further, in some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Although FIGS. 1A and 1B describes some embodiments, the following sections describe many other features and embodiments.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 2:
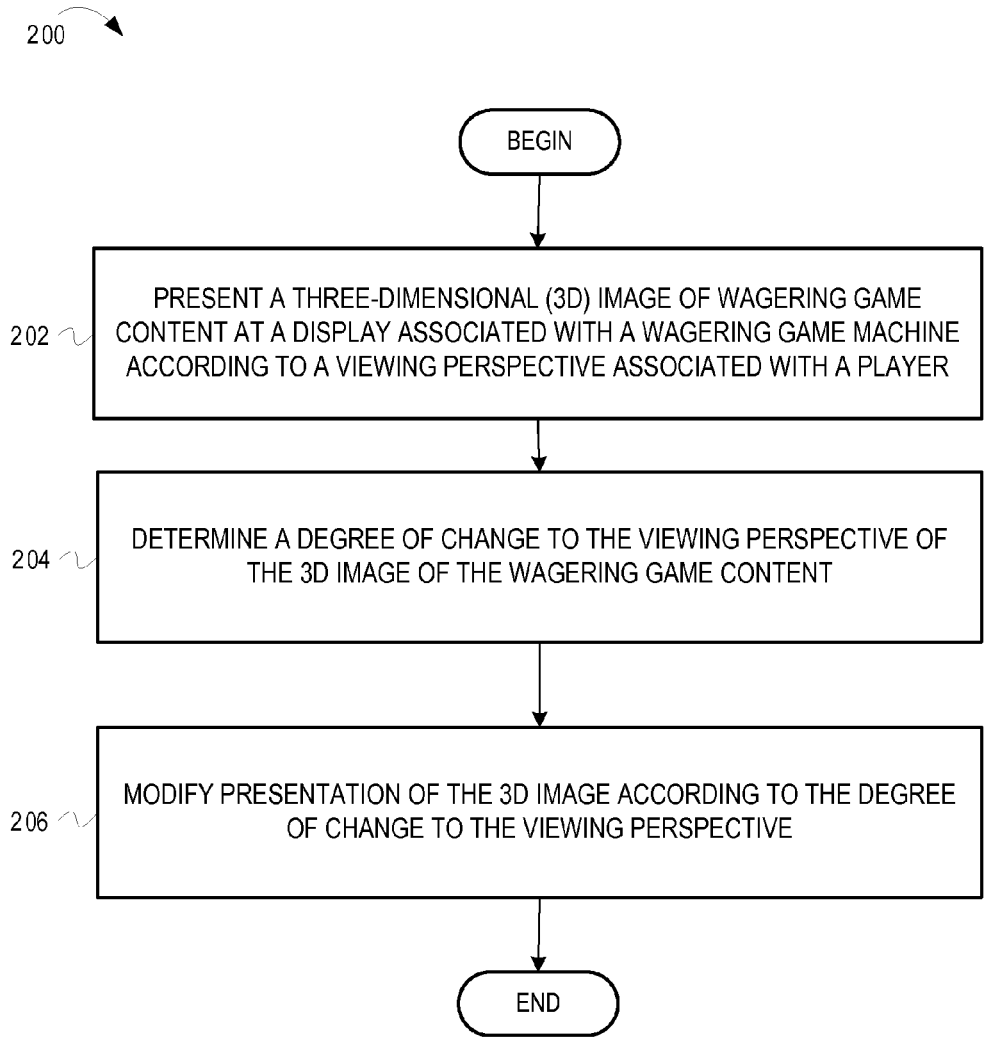
FIG. 2 is a flow diagram 200 illustrating modifying a three-dimensional image of wagering game content in response to a change in viewing perspective, according to some embodiments.

FIG. 2 is a flow diagram ("flow") 200 illustrating modifying a three-dimensional image of wagering game content in response to a change in viewing perspective, according to some embodiments. FIGS. 3A-3B, 4A-4D, and 5A-5C are conceptual diagrams that help illustrate the flow of FIG. 2, according to some embodiments. This description will present FIG. 2 in concert with FIGS. 3A-3B, 4A-4D, and 5A-5C. In FIG. 2, the flow 200 begins at processing block 202, where a wagering game system ("system") presents a three-dimensional (3D) image of wagering game content at a display associated with a wagering game machine according to a viewing perspective associated with a player. The system can utilize different 3D techniques and devices to present the perception of 3D. Some of those techniques and devices include, but are not limited to, the following: anaglyph images, polarized projections, autostereoscopic displays, computer-generated holography, volumetric displays, infrared laser projections, side-by-side viewing, autostereograms, pulfrich effects, prismatic & self-masking crossview glasses, lenticular prints, displays with filter arrays, wiggle stereoscopy, active 3D viewers (e.g., liquid crystal shutter glasses, red eye shutterglasses, virtual reality headsets, personal media viewers, etc.), passive 3D viewers (e.g., linearly polarized glasses, circularly polarized glasses, interference filter technology glasses, complementary color anaglyphs, compensating diopter glasses for red-cyan method, ColorCode 3D, ChromaDepth method and glasses, Anachrome "compatible" color anaglyph method, etc.), 3D televisions, etc.

Anaglyph images, for example, are used to provide a stereoscopic 3D effect when viewed with glasses where the two lenses are different (usually chromatically opposite) colors, such as red and cyan. The anaglyph images are made up of two color layers (one for each eye), superimposed, but offset with respect to each other to produce a depth effect when viewed through the glasses. Usually the main subject is in the center, while the foreground and background are shifted laterally in opposite directions. When the two color layers are viewed simultaneously through the anaglyph glasses, an integrated stereoscopic image appears. The visual cortex of the brain fuses the two images into the perception of a three-dimensional scene or composition.

In another example, polarized 3D glasses create the illusion of three-dimensional images by restricting the light that reaches each eye, an example of stereoscopy which exploits the polarization of light. To present a stereoscopic video, two images are projected superimposed onto the same screen through different polarizing filters. The observer wears eyeglasses which also contain a pair of different polarizing filters. Each of the observer's eyes sees a different image as each filter passes only that light which is similarly polarized and blocks the light polarized in the opposite direction. The use of the polarized 3D glasses thus produces a three-dimensional effect by projecting the same scene into both the observer's eyes, but depicted from slightly different perspectives. Because no head tracking is involved, several people can view the stereoscopic images at the same time.

In another example, autostereoscopic displays use optical trickery at the display, via one or more autostereoscopic elements incorporated into the autostereoscopic display, rather than worn by the user, to ensure that each eye sees the appropriate image. Some examples of autostereoscopic displays include parallax barrier display devices and lenticular lens display devices. For instance, parallax barrier display devices present stereoscopic images by sets of pixels, each set of pixels presenting a separate view of a 3D image for separate ones of the observer's eyes, with a barrier that directs the presentation of the sets of pixels according to the perspectives of the observer's eyes. Specifically, a parallax barrier presents a first image on first pixels and a second image on second pixels. The first image is viewable by a first eye (e.g., the right eye) through first holes in the parallax barrier and the second image if viewable by a second eye (e.g., the left eye) through second holes in the parallax barrier, creating a stereoscopic effect. A first set of pixels on the autostereoscopic display present the first image, via the first holes in the parallax barrier, at an angle that is only viewable by the first eye (e.g., the right eye), while, at the same time, solid portions of the parallax barrier block the presentation of the first set of pixels from being seen by the second eye (e.g., the left eye). At the same time, a second set of pixels on the autostereoscopic display present the second image, via the second holes in the parallax barrier, at an angle that is only viewable by the second eye (e.g., the left eye), while, at the same time, solid portions of the parallax barrier block the presentation of the second set of pixels from being seen by the first eye (e.g., the right eye). Thus, if an observer moves his or her head beyond a specific degree, the movement will alter the angles at which the first and second pixels are viewed, thus degrading and/or destroying the illusion of depth. Lenticular lens devices work by a similar concept except that lenses direct the light for the two images according to the separate viewing perspectives (e.g., separate viewing angles) of the individual eyes of the observer.

In another example, automultiscopic displays include view-dependent pixels with different intensities and colors based on the viewing angle (i.e., a number of different views of the same scene can be seen by moving horizontally around the display). In most automultiscopic displays the change of view is accompanied by the breakdown of the illusion of depth.

In another example, computer-generated holography utilizes devices that create a light field identical to that which would emanate from an original scene, with both horizontal and vertical parallax across a large range of viewing angles.

Volumetric displays are yet another example, where some physical mechanism is used to display points of light within a volume. Such displays use voxels instead of pixels. Volumetric displays include multiplanar displays, which have multiple display planes stacked up, and rotating panel displays, where a rotating panel sweeps out a volume.

Other technologies, for example, may include projecting light dots in the air above a device. An infrared laser is focused on the destination in space, generating a small bubble of plasma which emits visible light.

Figure 3A:
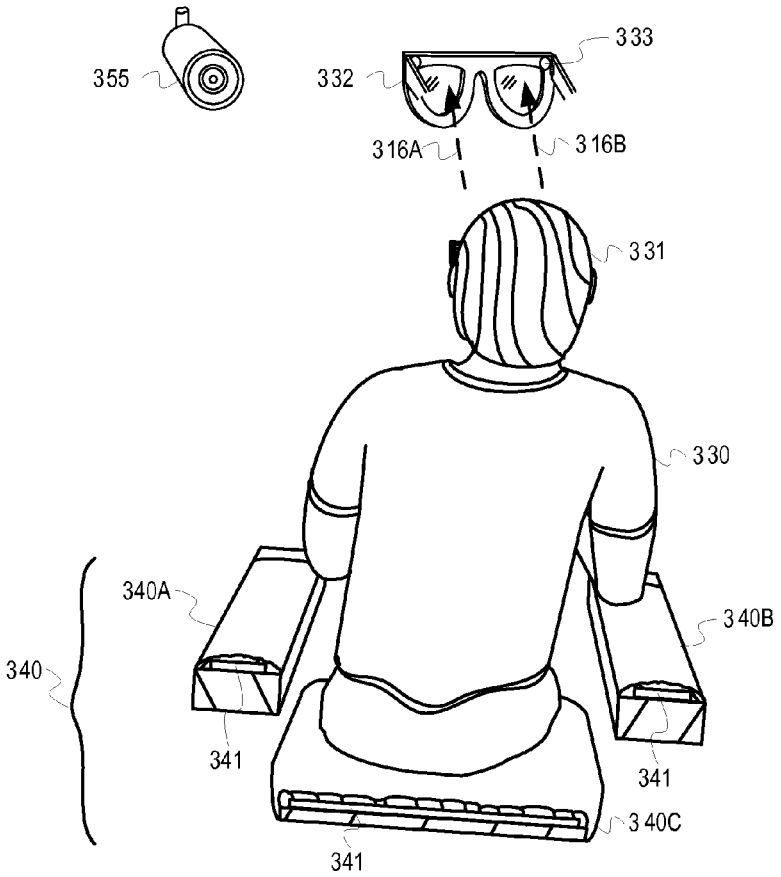
FIGS. 3A-3B are illustrations of detecting a change in viewing perspective associated with a three-dimensional presentation of wagering game content, according to some embodiments.
Figure 3B:
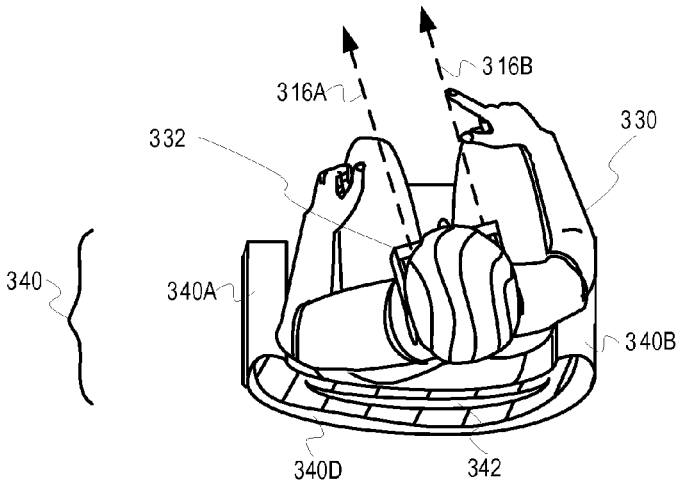

The flow 200 continues at processing block 204, where the system determines a degree of change to the viewing perspective of the 3D image of the wagering game content. For example, the system can receive one or more signals from one or more movement tracking devices connected to, or associated with, the wagering game machine. The one or more signals indicate a change in position (e.g., location, orientation, pose, etc.) of an occupant. The system can then calculate a degree of alteration to a viewing perspective of the three-dimensional image that would be caused by the change in position of the occupant (e.g., a change to a viewing angle at which the content is observed, a change to a stereoscopic field of view of the content on the display, etc.). FIGS. 3A and 3B illustrate examples of movement tracking devices. FIGS. 3A and 3B include a chair 340 (similar to the chair 140 shown in FIGS. 1A and 1B), a camera 355, and a 3D viewer device (i.e., passive 3D viewing glasses 332). The chair 340 includes two armrests 340A and 340B, a seat 340C, and a back 340D. FIG. 3A shows a rear perspective view of the chair 340 with the back 340D removed and cut-away perspective views of the armrests 340A and 340B, and the seat 340C. Within the armrests 340A and 340B and the seat 340C are pressure sensors 341 that detect movement of a player 330 that sits in the chair 340, such as movement causes by automatic movement of the chair 340. The back 340D also includes a pressure sensor 342. The pressure sensors 341 and 342 detect pressures that correspond to various parts of the body of the player 330 and may correlate to a reorientation of the body of the player 330, which implies a repositioning of the head 331. As the player 330 moves, and/or is moved, signals can be sent from the pressure sensors 341 and 342 to a module in the system that calculates, or estimates, a degree of alteration to the viewing perspective (e.g., sends the signals to 3D gaming modules 864 or 865 illustrated in FIG. 8). The module can receive the signals and interpret them as movement measurement values (e.g. a shifting of the body to the right indicates a movement of the head 331 to the right). Other devices, external to the chair 340, such as a camera 355, can also detect movement and repositioning of the head 331 (e.g., via head tracking) and send signals to the module. The camera 355 can be positioned near a display, or within a display, that presents the 3D wagering game content. Other movement tracking devices that may measure movement and repositioning of the head may include a location tracking sensor 333 in the passive 3D viewing glasses ("3D glasses") 332 worn by the player 340.

Figure 4A:
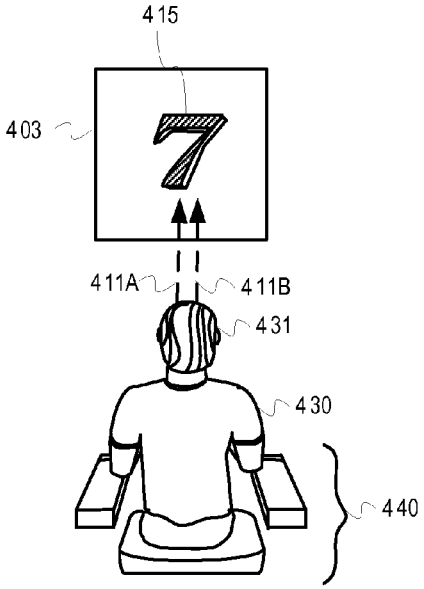
FIG. 4A-4D are illustrations of modifying a three-dimensional image of wagering game content in response to a change in viewing perspective, according to some embodiments.
Figure 4B:
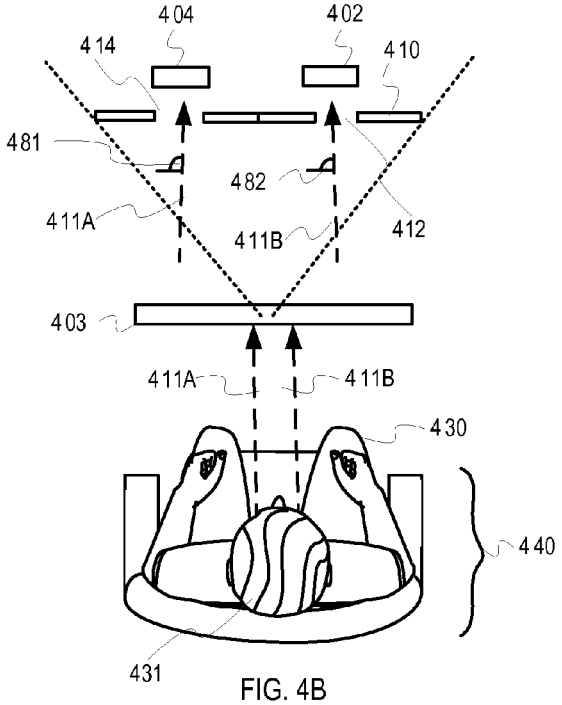

As a result of receiving signals that indicate movement by the player 330 (e.g. via the pressure sensors 341 and 342, via the camera 355, via the location tracking sensor 333, etc.), the system can calculate a degree of alteration to perspective views 316A and 316B, associated with locations of eyes of the player 330, compared to previous perspective views prior to the movement of the observer. For instance, FIGS. 4A-4D illustrate an example where a player 430 observes a 3D image of an object 415 on an autostereoscopic display ("display") 403. In FIGS. 4A and 4B, a player is sitting directly in front of the object 415, and has a viewing perspective that includes a left eye viewing perspective 411A and a right eye viewing perspective 411B that are primarily tangential and centered to a front, or viewing surface, of the display 403. The display 403 includes at least a first pixel 402 and a second pixel 404. The first pixel 402, in FIG. 4B, is positioned, and centered, directly in front of a first hole 412 of a parallax barrier 410 so that the left eye viewing perspective 411A sees directly through the first hole 412 to the first pixel 402. The second pixel 404 is also positioned, and centered, directly in front of a second hole 414 of the parallax barrier 410 so that the right eye viewing perspective 411B sees directly through the second hole 414 to the second pixel 404. The first pixel 402 presents a first version of a 3D image of the object 415, and the second pixel 404 presents a second version of the 3D image of the object 415. The second version of the 3D image of the object 415 is nearly identical to the first version of the 3D image of the object 415, but is slightly offset to a degree that causes the object 415 to have a stereoscopic effect when viewed via the left eye viewing perspective 411A and the right eye viewing perspective 411B.

Figure 4C:
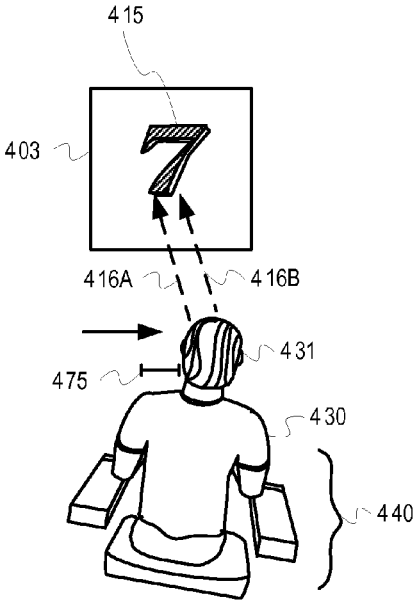
Figure 4D:
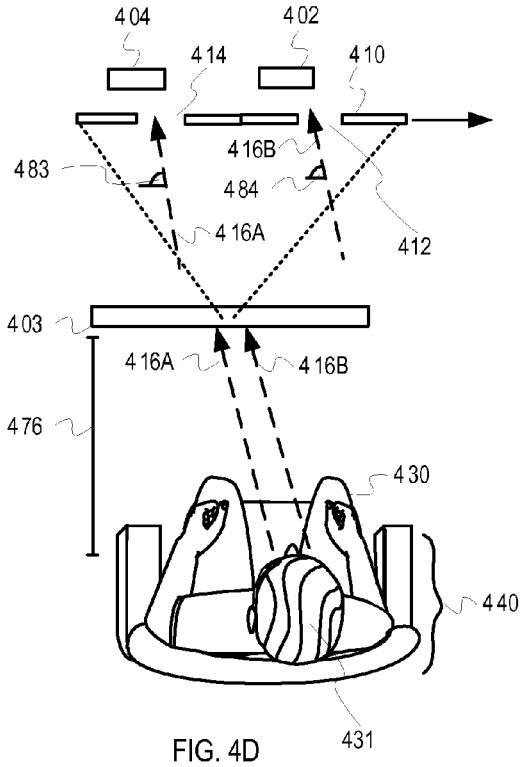

In FIGS. 4C and 4D, the player 430 experiences movement (e.g., by shifting in a chair 440, as a result of automatic movement of the chair 440, etc.), which causes a degree of change to a lateral position of a head 431 of the player 430. The change in lateral position of the head 431 causes a change in a perspective by the player 430. For instance, left eye viewing perspective 411A and a right eye viewing perspective 411B shift, resulting in left eye viewing perspective 416A and right eye viewing perspective 416B, which are no longer primarily tangential and/or centered to the front surface of the display 403, but, rather, the left eye viewing perspective 416A and right eye viewing perspective 416B are slightly changed to a degree that would cause a degradation in the stereoscopic effect of the first and second versions of the 3D images that comprise the 3D presentation of the object 415. Specifically, because of the change in the perspective by the player 430, the system calculates a degree to which the parallax barrier 410 would block the left eye viewing perspective 416A and right eye viewing perspective 416B from seeing the respective pixels 402 and 404, and the system automatically moves the parallax barrier 410 (e.g. shifts some, or all portions, of the parallax barrier 410) so that the holes 412 and 414 provide a clear and direct view of the first pixel 402 and the second pixel 404 via the left eye viewing perspective 416A and the right eye viewing perspective 416B. Thus, the left eye and right eye of the player 430 maintain a direct view of the two versions of the 3D images presented by the first pixel 402 and the second pixel 404, which, cooperatively, maintain the stereoscopic 3D effect that was presented in FIGS. 4A and 4B. The system can calculate a degree of movement for the parallax barrier 410 by first calculating a degree of change to a viewing angle (in relation to a viewing surface of the display 403) based on the movement of the player 430 in the chair 440. For instance, the system determines a first lateral distance 475 that the player 430 has moved his head 431 from a previous (e.g., centralized) position. The system also determines a second distance 476 that the head 431 is from the display 403. The system, thus, can calculate first viewing angles 481 and 482 from before the movement and second viewing angles 483 and 484 during, and after, the movement, and, based on differences in the viewing angles, determine a degree to which the parallax barrier 410 should be modified. The system can further determine data about specific characteristics, attributes, or actions of the player 430 that the system can use to calculate a modification to viewing perspectives of the player 430 during a gaming session. For example, the system can determine physical attributes (e.g., measure a physical distance between the eyes of the player 430, determine a glasses prescription of the player 430 from a profile or account setting, determine a weight for the player 430 to more accurately measure pressure on sensors in the chair 440, etc.) and determine habits of the player 430 (e.g., detect that the player 430 tends to lean his head 431 left or right, determine that the player 430 likes to lean forward, etc.). The system can also determine characteristics, attributes, actions, etc. of the chair 440 that the system can use to calculate a modification to viewing perspectives of the player 430 during a gaming session. For example, the system can measure physical attributes of the chair 440 (e.g., height of the chair 440, tilt of the chair 440, rotational range of the chair 440, height of an armrest of the chair 440, etc.) and measure actions of the chair 440 (e.g., rotational movement of the chair 440, lateral movement of the chair 440, etc.) that imply a potential change in perspective of the player 430.

The system can further utilize game data from the wagering game content to anticipate a degree of potential alteration to viewing perspective of the player 430. For example, a wagering game can automatically move the chair 440 based on events, or triggers, that occur within the wagering game. Thus, in response to the events, or triggers, in the wagering game, the system can anticipate that a viewing perspective of the player 430 will change and can calculate a degree to which to modify position of the parallax barrier 410. The system can utilize a combination of the ways (e.g., triggers from the wagering game content, signals generated from sensors, measurements of player movement via cameras, movement of passive or active 3D viewers, etc.) for determining an alteration (or at least estimating a potential alteration) to a viewing perspective or the system. The system can utilize the ways to improve each other and more accurately determine a degree of change to the viewing perspective. Furthermore, in some embodiments, instead of, or in addition to, automatically moving the parallax barrier 410, the system can shift a depiction of an image to a neighboring pixel. In examples of lenticular lens 3D displays, the system can move a lens position and/or shift imagery on pixels.

The flow 200 continues at processing block 206, where the system modifies presentation of the 3D image according to the degree of change to the viewing perspective. The system can modify positioning of pixel content, size and/or position of parallax barriers, focus or position of lenticular lenses, etc. that impart stereoscopic presentation of the 3D image based on the location of a player's eyes, during, and after, the player's movement (e.g., based on the lateral movement of head that would affect the parallax associated with the stereoscopic 3D presentation of the image of the wagering game content). For example, as in FIGS. 4A-4D, the system modified a position of the parallax barrier 410. In other examples, the system can shift presentation of the images on the pixels 404 and 402 to neighboring (e.g., adjacent, nearby, etc.) pixels.

Referring again to FIG. 2, in some embodiments, the system can modify the presentation of the 3D image to compensate for the player's movement and maintain an appearance of the image as it appeared in a previous viewing perspective. For instance, in some embodiments, the system can modify a stereoscopic effect of the presentation of the 3D image proportional to a degree of change of position of an observer. The system can modify an orientation and/or content of an element of the display (e.g., modify a position of a parallax barrier, modify a position of a hole associated with a parallax barrier, modify an orientation of a lenticular lens, modify content depicted via a pixel, etc.) at a location of the display associated with the 3D image proportional to the degree of change in the position of the observer. For example, in FIGS. 4A-4D, the system modifies the position of the parallax barrier 410 proportional to the movement of the player 430 so that the appearance of the object 415 maintains a consistent appearance throughout the movement of the player 430 within the chair 440.

Figure 5A:
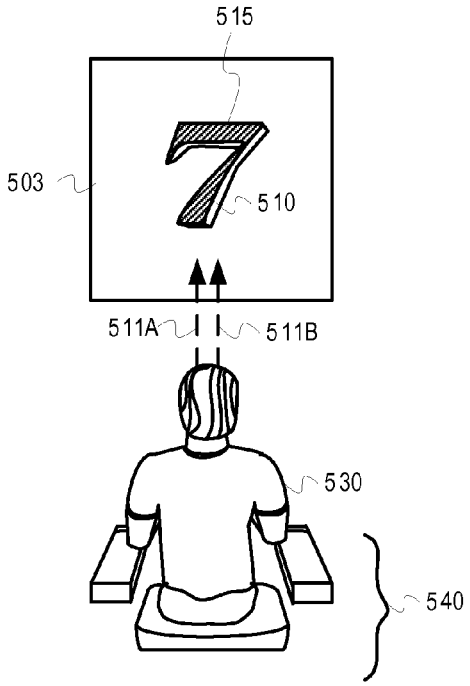
FIGS. 5A-5C are illustrations of a wagering game system 500, according to some embodiments.
Figure 5B:
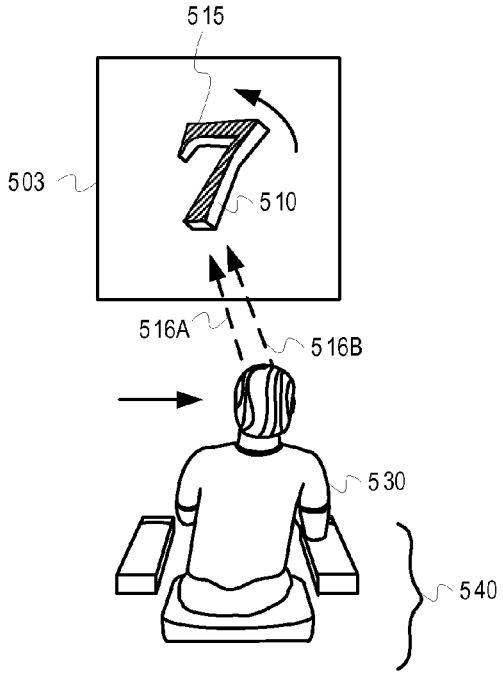
Figure 5C:
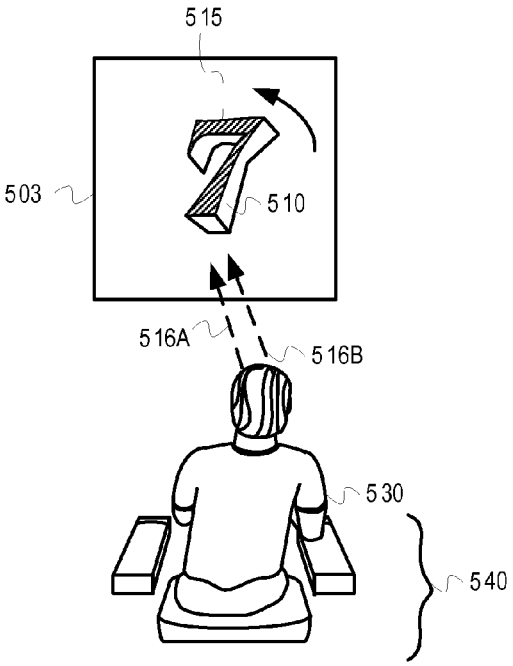

In some embodiments, the system can augment, or exaggerate, the perspective of the object 415 to cause the object 415 to appear to move beyond a range of motion, or movement, of the player 430 within the chair 440. For example, if the player 430 remains primarily seated in the chair 440, the player 430 is confined in lateral movement by the boundaries of the chair 440 and/or the degree to which the chair 440 was designed to move. For instance, if the chair 440 has armrests (as depicted), the armrests of the chair 440 restrict a range of lateral movement. In other examples, if the chair 440 had no armrests, then the lateral movement of the player 430 may still have a limited range of motion if the player 430 desires to remain seated in the chair 440 because the player 430 would fall out of the chair if the player 430 moved too far laterally. Some embodiments can cause the object 415 to appear to move, or enhance the 3D effect of the object 415, even after the player 430 has reached a limit to the range of movement or motion in a lateral direction. For example, in FIGS. 5A-5C, a player 530 is seated in a chair 540 in front of a 3D display ("display") 503. The display 503 presents an object 515 of wagering game content. In FIG. 5A, when the player 530 is seated in a first position, the player has a first left eye viewing perspective 511A and a first right eye viewing perspective 511B. In FIG. 5B, the player 530 shifts in the chair 540, and/or is caused to shift in the chair 540, and moves his head laterally to the right, to a second position, which shifts the player's perspective to a second left eye viewing perspective 516A and a second right eye viewing perspective 516B. As the player 530 shifts in the chair 540, the system calculates a degree of change to the player's perspective and modifies the 3D, or parallax, effect of a view of the object 515, beyond what appears to be based on the limit of the range of motion in the lateral direction of the chair 540. For instance, the system can change or shift 3D characteristics of the object 515, such as by increasing a degree of depth perception of the object 515 in proportion to a change in perspective view of the object 515 while the chair 540 makes its lateral movement. The object 515 appears to skew in shape as if it is rotating, which increases a degree of parallax for the object 515, causing a visible increase to a presentation size of the depth wall 510 of the object 515. In FIG. 5C, after the player 530 has stopped moving laterally to the right, the system can cause the object 515 to continue to appear to rotate, thus further increasing a degree of parallax, or illusion of depth, of the object 515 (e.g., which further increases the presentation size of the depth wall 510 and further skews the shape of the object 515). In other words, in FIG. 5C, the left eye viewing perspective 516A and right eye viewing perspective 516B remain the same as in FIG. 5B, because the player 530 is restricted from moving laterally to the right. However, the system, enhances the 3D effect of the object 515 to create an effect that looks, from the perspective the player 530, to continue to move in a way (e.g. in a direction, according to a velocity, with a given rotational motion, etc.) that the lateral movement of the player 530 had previously initiated, but was limited by the range of the movement of the player 530 within the chair 540.

Figure 6:
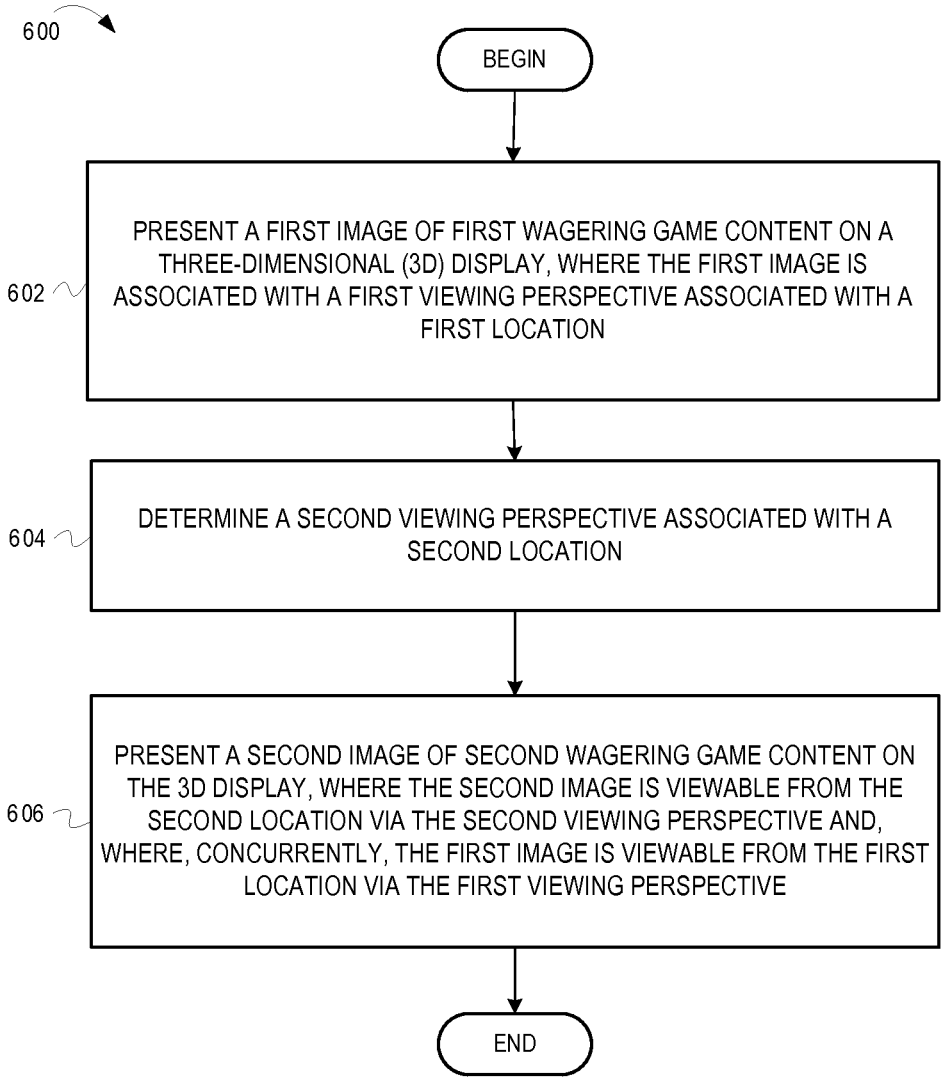
FIG. 6 is a flow diagram 600 illustrating presenting multiple, three-dimensional images of wagering game content according to multiple player perspectives, according to some embodiments.
Figure 7:
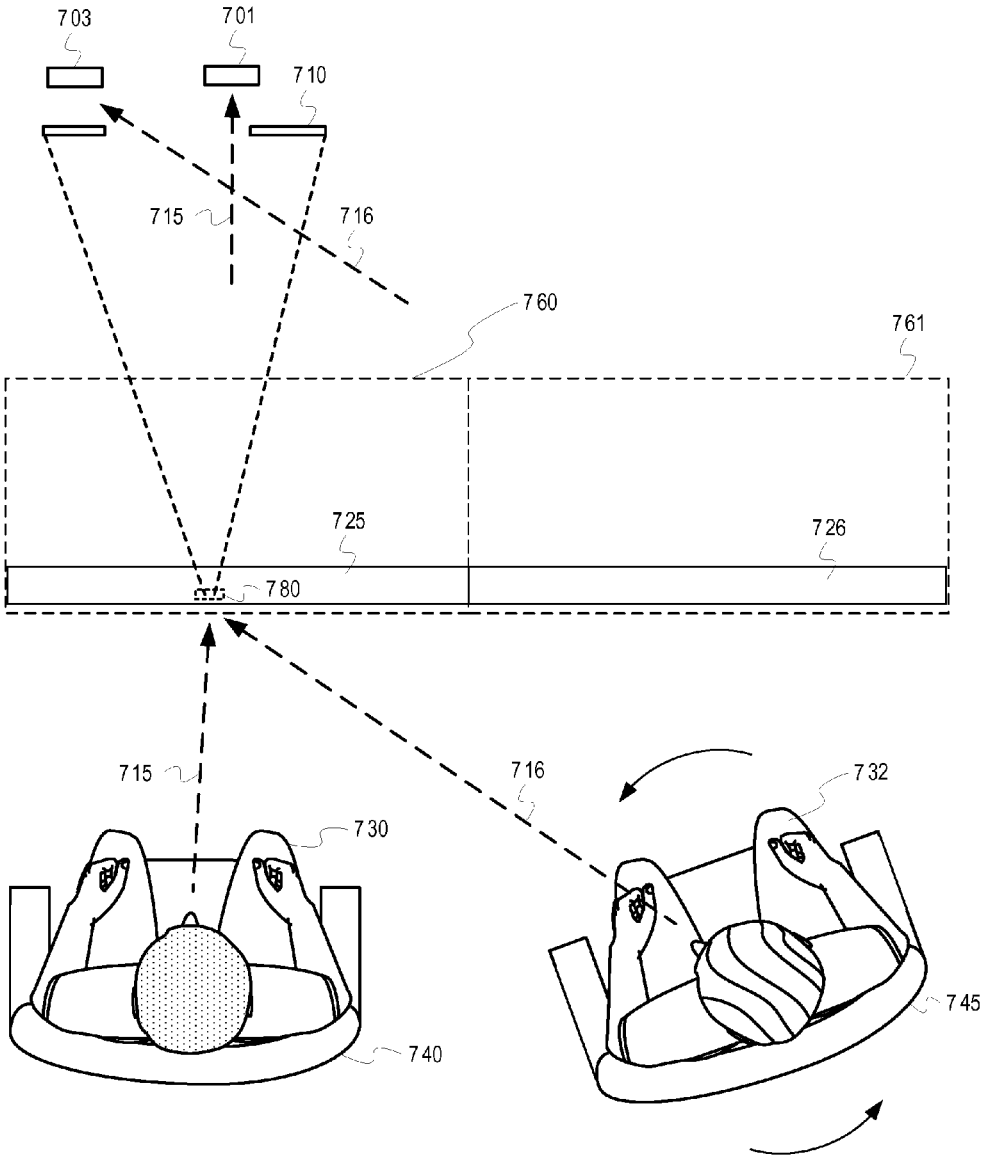
FIG. 7 is an illustration of presenting multiple, three-dimensional images of wagering game content for multiple player perspectives, according to some embodiments.

FIG. 6 is a flow diagram ("flow") 600 illustrating presenting multiple three-dimensional images of wagering game content according to multiple player perspectives, according to some embodiments. FIG. 7 is a conceptual diagram that helps illustrate the flow of FIG. 6, according to some embodiments. This description will present FIG. 6 in concert with FIG. 7. In FIG. 6, the flow 600 begins at processing block 602, where a wagering game system ("system") presents a first image of first wagering game content on a three-dimensional (3D) display, where the first image is associated with a first viewing perspective associated with a first location. For example, in FIG. 7, a first player 730 is at a first location (e.g., seated in a first chair 740 in front of a first 3D display 725 associated with a first wagering game machine 760). The first player 730 has a first viewing perspective 715 that views the first 3D display ("first display") 725 at a first viewing angle. The visual focus of the first player 730 may be focused on a viewing zone 780 of the first display 725 where a first image of first wagering game content is presented via a 3D (e.g., stereoscopic) effect. The first display 725, for instance, sets a configuration (e.g., for a parallax barrier 710) so that the first viewing perspective 715 views a first pixel 701, from a first set of pixels. The first set of pixels presents the first image for the first wagering game content (e.g., for a first wagering game). In other words, the first player 730 can see the first wagering game content on the display 725 (at the zone 780) because the parallax barrier 710 permits viewing of the first wagering game content at the viewing angle for the first player 730.

The flow 600 continues at processing block 604, where the system determines a second viewing perspective associated with a second location. For example, in FIG. 7, a second player 732 is at a second location (e.g., seated in a second chair 745 in front of a second 3D display 726 associated with a second wagering game machine 761 adjacent to the first wagering game machine 760). The second player 732 has a second viewing perspective 716 that views the first 3D display ("display") 725 at a second viewing angle. For example, the second chair 745 may have rotated causing the second player 732 to change viewing perspective.

The flow 600 continues at processing block 606, where the system presents a second image of second wagering game content on the 3D display, where the second image is viewable from the second location via the second viewing perspective and, where, concurrently, the first image is viewable from the first location via the first viewing perspective. For instance, the system can present a second image from a second set of pixels of an autostereoscopic display, where the second set of pixels are viewable from the second viewing perspective and not from the first viewing perspective, while simultaneously, the first image is presented from the first set of pixels of the autostereoscopic display. If FIG. 7, for example, the first display 725 sets a configuration that the second viewing perspective 716 views a second pixel 703, from a second set of pixels, while the first viewing perspective 715 views the first pixel 701. For example, the system can modify a position of the parallax barrier 410 and/or select and activate the second pixel 703 based on the viewing angle of the second viewing perspective 716. The visual focus of the second player 732 may also be focused on the viewing zone 780 of the first display 725. The second set of pixels (to which the second pixel 703 belongs) presents a second image in 3D (e.g., with a stereoscopic effect) for second wagering game content (e.g., for a second wagering game) that may be associated with (e.g., controlled by, presented in response to player input from, etc.) the second wagering game machine 761. For example, the second player 732 can see secondary game content (e.g., server-side games), player account information, etc., on the zone 780 of the first display 725, while the player 732 can see primary wagering game content, from the second wagering game machine 761, on the second 3D display ("second display") 726. In the example shown in FIG. 7, both viewing perspectives 715 and 716 are focused on a common zone (e.g., zone 780), where the pixels 703 and 701 are close enough to each other to represent substantially similar viewing fields or areas (e.g., adjacent to each other, within substantially close proximity to represent the same picture area, within a pixel group assigned to the same hole on a parallax barrier or to the same lenticular lens, assigned to zones with a majority of overlapping viewing space, etc.). In other embodiments, the first display 725 can present separate content at other zones, not only at the same zone. In some embodiments, the entire first display 725 can appear, to the second player 732, like a continuation of the second content presented on the second display 726, while, vice verse, the entire second display 726 can appear, to the first player 730, like a continuation of the first content presented on the first display 725.

In some embodiments, the first display and second display 726 may be separate displays. In some embodiments, the first display and second display 726 may appear to be the same display (e.g., flush against each other as shown in FIG. 7). In some embodiments, the first display 725 and second display 726 may be the same display, such as a table-top display at an electronic gaming table (e-table), a large panel screen in front of multiple players, etc. For instance, the e-table may have multiple player stations for separate players, but each player can see different 3D content concurrently, either at the same viewing zone, or at different viewing zones, based on the player's position at the e-table.

Additional Example Embodiments

According to some embodiments, a wagering game system ("system") can provide various example devices, operations, etc., to modify three-dimensional, wagering-game content to perspective. The following non-exhaustive list enumerates some possible embodiments.

Using analysis of player reactions for modification of 3D presentations. In some embodiments, the system can perform a series of automatic movements to a chair at a wagering game machine and analyze how an occupant of the chair reacts to specific types and degrees of automatic movements. The system can use the analysis of the player's reactions to predict a player's reaction to future automatic movements of the chair. Based on the prediction, the system can more accurately estimate a degree of potential change to a player's perspective, and, thus, more accurately modify presentation of 3D wagering game content to a player's change of viewing perspective.

Layered displays. In some embodiments, the system can modify presentation of 3D wagering game content on multiple layers of a 3D display associated with a wagering game machine and/or multiple linked (e.g., peripheral) 3D displays.

Tracking motion of player controls. In some embodiments, the system can track movement of devices held, or possessed by, a player. For example, the system can track movement of a player by tracking a movement of a control wand that is used by the player in a wagering game, or movement of a cell phone, or other mobile device, possessed by the player.

Tracking motion of devices connected to the wagering game machine. In some embodiments, in addition to, or instead of, a chair, other devices connected to the wagering game machine may automatically move, which may affect a player's eye position, and thus affect the perspective of player viewing a stereoscopic effect of 3D content. For example, the player may stand on a treadmill device, sports equipment props (e.g., skis), a rotating apparatus, etc. The entire player, or any portion of the player, may be enclosed in a device (e.g., a pod, a cockpit, a helmet, etc.) that contacts the player's body in any manner (e.g., contacts the player's feet, legs, arms, head, etc.). In some embodiments, certain devices may spray liquids or gases (e.g., spray a water mist, send a puff of air, etc.) that might cause a player to move. Essentially, the system can receive input or output from any device that may cause movement of the player, either directly or indirectly (e.g., via inducement), and measure or estimate the movement to predict a degree of eye movement. Based on the system's measurements or estimates, whether by direct measurement or interpolation, the system can determine a change to the observer's perspective and adjust presentation of the stereoscopic 3D effect.

Tracking a player's focus. In some embodiments, the system can track eye movement of a player, or multiple players, to determine a player's focus on a specific part of a 3D display. In response, the system can cause only the focused area on the 3D display to become more optimized, higher resolution, or otherwise modified.

Multiple player perspectives on a single display. In some embodiments, the system can present card hands to each of a number of players at an e-table. The e-table may have one display, where a portion of the display is assigned to separate ones of the players. However, the system presents the card hands on the display so that only each player can see their own hand based on each player's viewing perspective in front of the graphical presentation of the cards. The other players, however, at the other player stations, cannot see the other player's hands, even though every player's card hands are presented on the display.

Detecting horizontal and vertical perspective changes. In some embodiments, the system can utilize vertical and horizontal parallax barriers and/or lenticular lenses on a display, which the system can utilize to track a player's vertical and horizontal perspective changes.

Modifying 3D audio. In some embodiments, the system can adjust audio presentations in addition to, and in response to, changes to 3D wagering game content. For example, the system can cause audio to move in an exaggerated way (e.g., causing an audio balance to continue to move more to a specific direction) even though a player's physical movement is limited by a chair's dimensions and/or constraints.

Example Operating Environments

This section describes example operating environments, systems, and networks and presents structural aspects of some embodiments.

Wagering Game System Architecture

Figure 8:
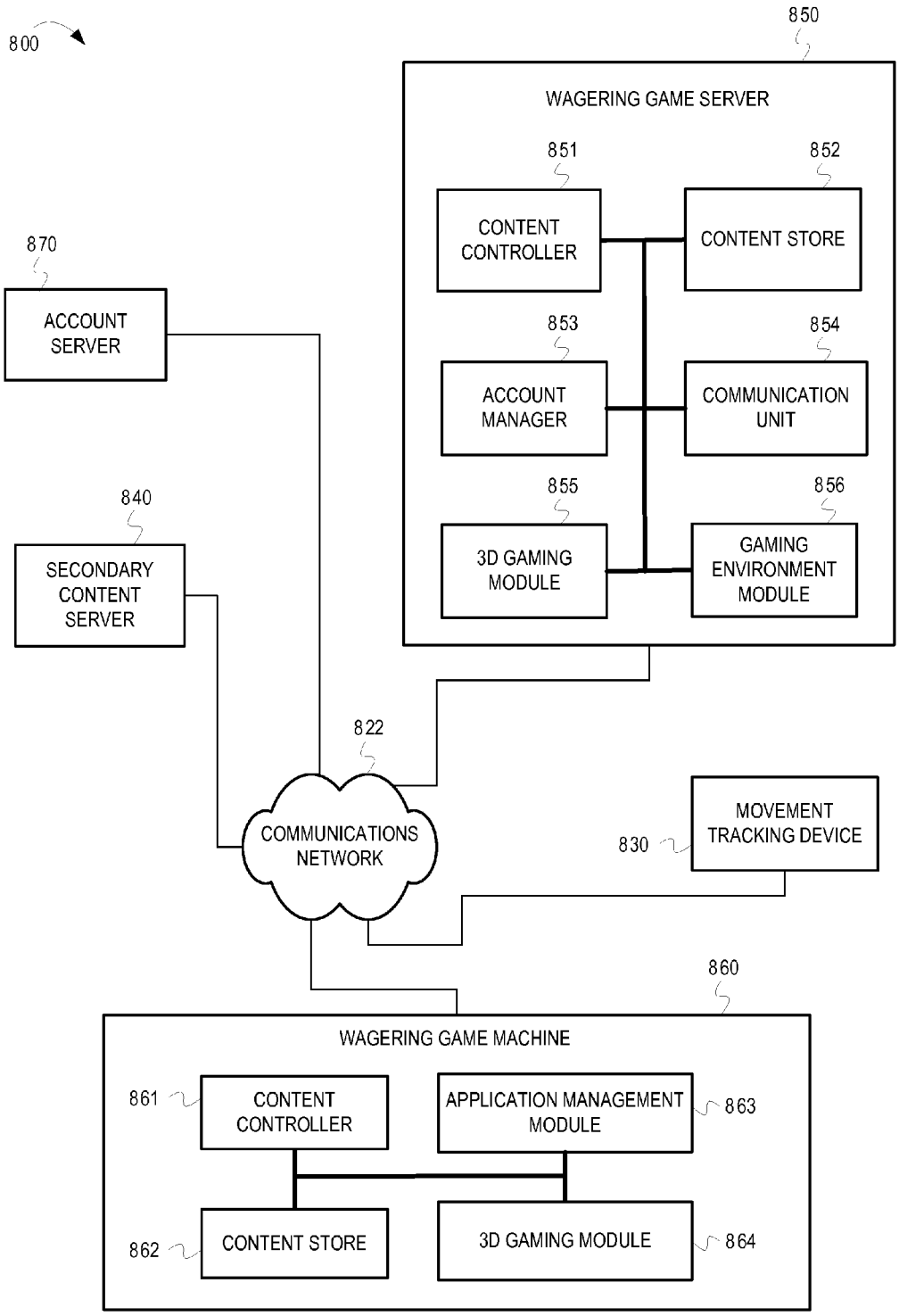
FIG. 8 is an illustration of a wagering game system architecture 800, according to some embodiments.

FIG. 8 is a conceptual diagram that illustrates an example of a wagering game system architecture 800, according to some embodiments. The wagering game system architecture 800 can include an account server 870 configured to control user related accounts accessible via wagering game networks and social networking networks. The account server 870 can store wagering game player account information, such as account settings (e.g., settings related to group games, etc., settings related to social contacts, etc.), preferences (e.g., player preferences regarding content presentable via 3D, player preferences regarding award types, preferences related to virtual assets, etc.), player profile data (e.g., name, avatar, screen name, etc.), and other information for a player's account (e.g., financial information, account identification numbers, virtual assets, social contact information, physical characteristics, etc.). The account server 870 can contain lists of social contacts referenced by a player account. The account server 870 can also provide auditing capabilities, according to regulatory rules. The account server 870 can also track performance of players, machines, and servers.

The wagering game system architecture 800 can also include a wagering game server 850 configured to control wagering game content, provide random numbers, and communicate wagering game information, account information, and other information to and from a wagering game machine 860. The wagering game server 850 can include a content controller 851 configured to manage and control content for presentation on the wagering game machine 860. For example, the content controller 851 can generate game results (e.g., win/loss values), including win amounts, for games played on the wagering game machine 860. The content controller 851 can communicate the game results to the wagering game machine 860. The content controller 851 can also generate random numbers and provide them to the wagering game machine 860 so that the wagering game machine 860 can generate game results. The wagering game server 850 can also include a content store 852 configured to contain content to present on the wagering game machine 860. The wagering game server 850 can also include an account manager 853 configured to control information related to player accounts. For example, the account manager 853 can communicate wager amounts, game results amounts (e.g., win amounts), bonus game amounts, etc., to the account server 870. The wagering game server 850 can also include a communication unit 854 configured to communicate information to the wagering game machine 860 and to communicate with other systems, devices and networks. The wagering game server 850 can also include a 3D gaming module 855 configured to modify 3D presentation of content according to changes in perspective, viewing position, etc. The wagering game server 850 can also include a gaming environment module 856 configured to present environmental light and sound effects in a casino environment. The gaming environment module 856 is further configured to provide content data, user data, and control information regarding gaming effects within a casino environment. For example, the gaming environment module 856 can coordinate a synchronized presentation of lighting and sound effects across a bank of wagering game machines and/or other lighting and sound producing devices within one or more areas of a casino. The gaming environment module 856 can also be configured to detect gaming events, such as events generated by the wagering game server 850 and/or the wagering game machine 860. The gaming environment module 856 can generate data for a synchronized light/sound show based on the gaming events. The gaming environment module 856 can control environmental light presentation devices within a casino. The gaming environment module 856 can provide emotive lighting presentation data, including light presentation commands on emotive lighting devices on or near wagering game machines, as well as other devices within the casino such as spotlights, overhead emotive lighting, projectors, etc. The gaming environment module 856 can be configured to determine multi-media, casino-content, including casino-wide special effects that include sound effects and light effects. The multi-media casino content can be presentable across a plurality of casino content presentation devices ("presentation devices") in a casino. The multi-media, casino-content effect can be related to a wagering game presentation or event. The wagering game presentation or event can be tied to the functionality, activity, or purpose of a wagering game. For instance, wagering game presentations can be related to attracting wagering game players to groups of wagering game machines, presenting game related outcomes across multiple wagering game machines, expressing group gaming activity across multiple wagering game machines, focusing attention on a particular person or machine in response to a gaming event, etc. The presentation devices present sound and light effects that accompany a gaming event (e.g., a jackpot celebratory effect that focuses on a wagering game machine, a lightning strike that introduces a community gaming event, and a musical chair game that reveals a community wagering game winner). The gaming environment module 856 can also be configured to determine timing control data for the multi-media effect. In some embodiments, timing control data can be stored on the wagering game server 850, or be accessible to the gaming environment module 856 via another device (e.g., a lighting controller associated with a bank of wagering game machines), to use to send lighting commands in sequential order to network addresses of presentation device on a casino network. The gaming environment module 856 can determine channels assigned with casino-content presentation devices, such as the wagering game machine 860. In some embodiments, the presentation devices can have addresses assigned to a channel. For example, the wagering game machine 860 could be on one channel, peripheral devices could be on another channel, network light presentation devices can be on other channels, etc. In some embodiments, the gaming environment module 856 can be a DMX controller connected in parallel to an emotive lighting controller on, or associated with, the wagering game machine 860. The DMX controller can also be connected in parallel to a plurality of other presentation devices (e.g., other wagering game machines, lighting presentation devices, etc.) within a casino, and can simultaneously provide DMX lighting commands to the wagering game machine 860 and to the other presentation devices. DMX can change light intensity, or other light characteristics, over time. Some embodiments of DMX controllers can update commands very quickly (e.g., 30-47 times a second) across multiple channels (e.g., 512 channels). A DMX controller can put different commands in every channel (e.g., one channel can have show "X," one channel can have show "Y," etc.). The DMX can also have a frame number within a show. Some devices can take up more than one channel (e.g., an emotive light might have three colors and may take up a channel for each color, a spotlight might have seven channels, etc.). Each device can receive 512 bytes of data from the DMX controller at any given time interval (e.g., frame). The 512 bytes of data can be divided in different ways. For example, 6 bytes may address light effect behavior, 6 bytes may include show numbers, 6 bytes may include frame numbers, 1 byte may include priority values, and so on for various light effect characteristics (e.g., intensity, color, pan, tilt, etc.). The presentation device that receives the DMX command data is programmed to interpret the lighting data in the channel. In some embodiments, the presentation devices can be DMX compliant including having a DMX input port to accept DMX commands. In some embodiments, presentation devices can convert the DMX commands to proprietary commands. In addition to the DMX protocol, other types of dedicated lighting protocols can include AMX 192, CMX, SMX, PMX, protocols included in the EIA-485 standard, etc.

The wagering game system architecture 800 can also include the wagering game machine 860 configured to present wagering games, and other content, in 3D. The wagering game machine 860 can include a content controller 861 configured to manage and control content and presentation of content on the wagering game machine 860. The wagering game machine 860 can also include a content store 862 configured to contain content to present on the wagering game machine 860. The wagering game machine 860 can also include an application management module 863 configured to manage multiple instances of gaming applications. For example, the application management module 863 can be configured to launch, load, unload and control applications and instances of applications. The application management module 863 can launch different software players (e.g., a Microsoft® Silverlight™ player, an Adobe® Flash® player, etc.) and manage, coordinate, and prioritize what the software players do. The application management module 863 can also coordinate instances of server applications in addition to local copies of applications. The application management module 863 can control window locations on a wagering game screen or display for the multiple gaming applications. In some embodiments, the application management module 863 can manage window locations on multiple displays including displays on devices associated with and/or external to the wagering game machine 860 (e.g., a top display and a bottom display on the wagering game machine 860, a peripheral device connected to the wagering game machine 860, a mobile device connected to the wagering game machine 860, etc.). The application management module 863 can manage priority or precedence of client applications that compete for the same display area. For instance, the application management module 863 can determine each client application's precedence. The precedence may be static (i.e. set only when the client application first launches or connects) or dynamic. The applications may provide precedence values to the application management module 863, which the application management module 863 can use to establish order and priority. The precedence, or priority, values can be related to tilt events, administrative events, primary game events (e.g., hierarchical, levels, etc.), secondary game events, local bonus game events, advertising events, etc. As each client application runs, it can also inform the application management module 863 of its current presentation state. The applications may provide presentation state values to the application management module 863, which the application management module 863 can use to evaluate and assess priority. Examples of presentation states may include celebration states (e.g., indicates that client application is currently running a win celebration), playing states (e.g., indicates that the client application is currently playing), game starting states (e.g., indicates that the client application is showing an invitation or indication that a game is about to start), status update states (e.g., indicates that the client application is not 'playing' but has a change of status that should be annunciated, such as a change in progressive meter values or a change in a bonus game multiplier), idle states (e.g., indicates that the client application is idle), etc. In some embodiments, the application management module 863 can be pre-configurable. The system can provide controls and interfaces for operators to control screen layouts and other presentation features for the configuring the application management module 863. The application management module 863 can communicate with, and/or be a communication mechanism for, a base game stored on a wagering game machine. For example, the application management module 863 can communicate events from the base game such as the base game state, pay line status, bet amount status, etc. The application management module 863 can also provide events that assist and/or restrict the base game, such as providing bet amounts from secondary gaming applications, inhibiting play based on gaming event priority, etc. The application management module 863 can also communicate some (or all) financial information between the base game and other applications including amounts wagered, amounts won, base game outcomes, etc. The application management module 863 can also communicate pay table information such as possible outcomes, bonus frequency, etc. In some embodiments, the application management module 863 can control different types of applications. For example, the application management module 863 can perform rendering operations for presenting applications of varying platforms, formats, environments, programming languages, etc. For example, the application management module 863 can be written in one programming language format (e.g., JavaScript, Java, C++, etc.) but can manage, and communicate data from, applications that are written in other programming languages or that communicate in different data formats (e.g., Adobe® Flash®, Microsoft® Silverlight™, Adobe® Air™, hyper-text markup language, etc.). The application management module 863 can include a portable virtual machine capable of generating and executing code for the varying platforms, formats, environments, programming languages, etc. The application management module 863 can enable many-to-many messaging distribution and can enable the multiple applications to communicate with each other in a cross-manufacturer environment at the client application level. For example, multiple gaming applications on a wagering game machine may need to coordinate many different types of gaming and casino services events (e.g., financial or account access to run spins on the base game and/or run side bets, transacting drink orders, tracking player history and player loyalty points, etc.).

The wagering game machine 860 can also include a 3D gaming module 864 configured to modify 3D presentation of content according to changes in perspective, viewing position, etc.

The wagering game system architecture 800 can also include a movement tracking device 830 that tracks movement of a player during a wagering game session and determine changes in viewing perspective.

The wagering game system architecture 800 can also include a secondary content server 840 configured to provide content and control information for secondary games and other secondary content available on a wagering game network (e.g., secondary wagering game content, promotions content, advertising content, player tracking content, web content, etc.). The secondary content server 840 can provide "secondary" content, or content for "secondary" games presented on the wagering game machine 860. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. In some embodiments, the secondary content can be in one or more different formats, such as Adobe® Flash®, Microsoft® Silverlight™, Adobe® Air™, hyper-text markup language, etc. In some embodiments, the secondary content server 840 can provide and control content for community games, including networked games, social games, competitive games, or any other game that multiple players can participate in at the same time. In some embodiments, the secondary content server 840 can control and present an online website that hosts wagering games. The secondary content server 840 can also be configured to present multiple wagering game applications on the wagering game machine 860 via a wagering game website, or other gaming-type venue accessible via the Internet. The secondary content server 840 can host an online wagering website and/or a social networking website. The secondary content server 840 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). The secondary content server 840 can also be configured to provide content presentable via an application of a mobile device. In some embodiments, the secondary content server 840 can also host social networking accounts, provide social networking content, control social networking communications, store associated social contacts, etc. The secondary content server 840 can also provide chat functionality for a social networking website, a chat application, or any other social networking communications mechanism. In some embodiments, the secondary content server 840 can utilize player data to determine marketing promotions that may be of interest to a player account. The secondary content server 840 can also analyze player data and generate analytics for players, group players into demographics, integrate with third party marketing services and devices, etc. The secondary content server 840 can also provide player data to third parties that can use the player data for marketing. In some embodiments, the secondary content server 840 can provide one or more social networking communication mechanisms that publish (e.g., post, broadcast, etc.) a message to a mass (e.g., to multiple people, users, social contacts, accounts, etc.). The social networking communication mechanism can publish the message to the mass simultaneously. Examples of the published message may include, but not be limited to, a blog post, a mass message post, a news feed post, a profile status update, a mass chat feed, a mass text message broadcast, a video blog, a forum post, etc. Multiple users and/or accounts can access the published message and/or receive automated notifications of the published message.

Each component shown in the wagering game system architecture 800 is shown as a separate and distinct element connected via a communications network 822. However, some functions performed by one component could be performed by other components. For example, the wagering game server 850 can also be configured to perform functions of the application management module 863, and other network elements and/or system devices. Furthermore, the components shown may all be contained in one device, but some, or all, may be included in, or performed by, multiple devices, as in the configurations shown in FIG. 8 or other configurations not shown. For example, the account manager 853 and the communication unit 854 can be included in the wagering game machine 860 instead of, or in addition to, being a part of the wagering game server 850. Further, in some embodiments, the wagering game machine 860 can determine wagering game outcomes, generate random numbers, etc. instead of, or in addition to, the wagering game server 850.

The wagering game machines described herein (e.g., wagering game machine 860) can take any suitable form, such as floor standing models, handheld mobile wagering game machines, bar-top models, workstation-type console models, surface computing machines, etc. Further, wagering game machines can be primarily dedicated for use in conducting wagering games.

In some embodiments, wagering game machines and wagering game servers work together such that wagering game machines can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 800 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Wagering Game System

Figure 9:
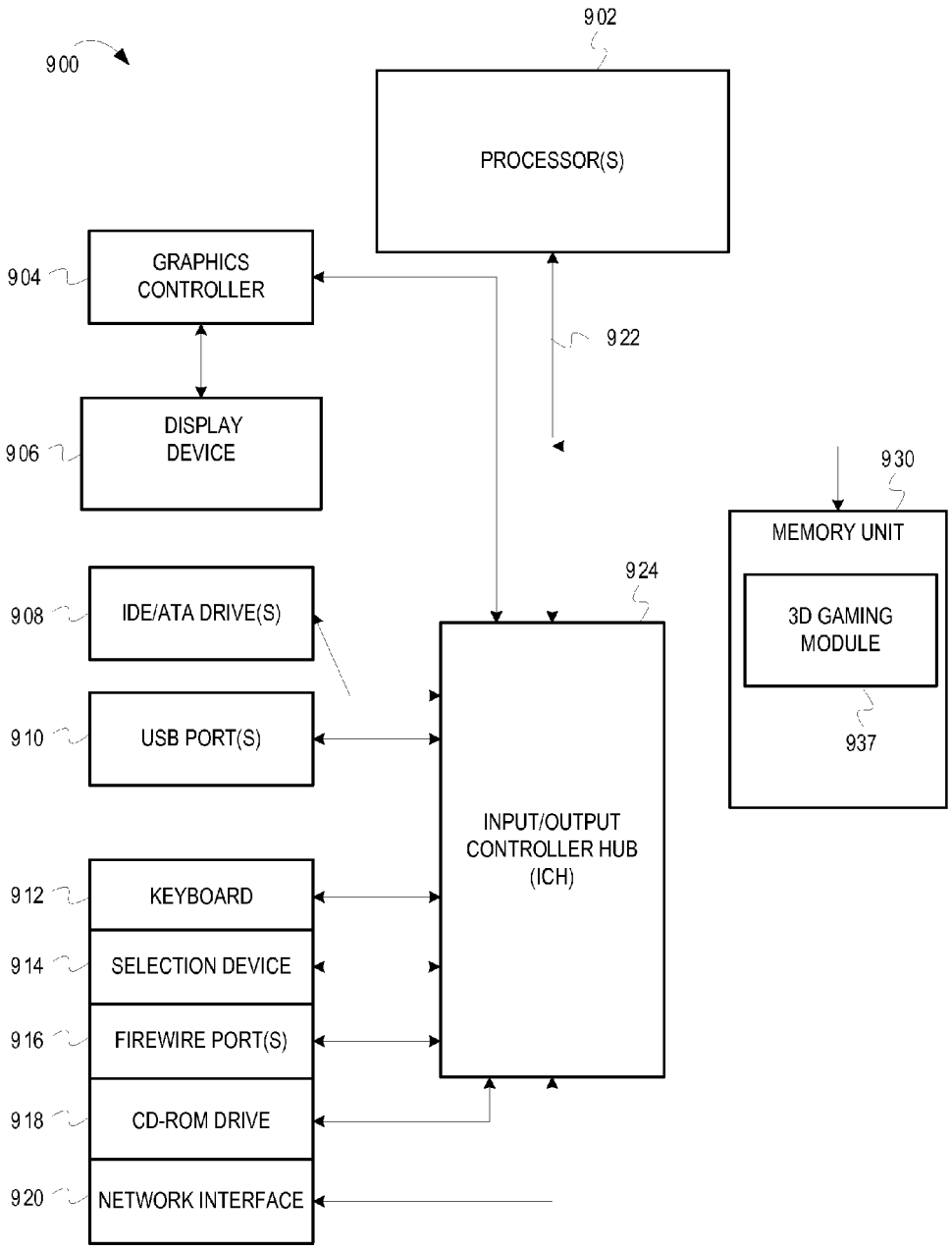
FIG. 9 is an illustration of a wagering game system 900, according to some embodiments.

FIG. 9 is a conceptual diagram that illustrates an example of a wagering game system 900, according to some embodiments. In FIG. 9, the wagering game computer system ("computer system") 900 may include a processor unit 902, a memory unit 930, a processor bus 922, and an Input/Output controller hub (ICH) 924. The processor unit 902, memory unit 930, and ICH 924 may be coupled to the processor bus 922. The processor unit 902 may comprise any suitable processor architecture. The computer system 900 may comprise one, two, three, or more processors, any of which may execute a set of instructions in accordance with some embodiments.

The memory unit 930 may also include an I/O scheduling policy unit and I/O schedulers. The memory unit 930 can store data and/or instructions, and may comprise any suitable memory, such as a dynamic random access memory (DRAM), for example. The computer system 900 may also include one or more suitable integrated drive electronics (IDE) drive(s) 908 and/or other suitable storage devices. A graphics controller 904 controls the display of information on a display device 906, according to some embodiments.

The ICH 924 provides an interface to I/O devices or peripheral components for the computer system 900. The ICH 924 may comprise any suitable interface controller to provide for any suitable communication link to the processor unit 902, memory unit 930 and/or to any suitable device or component in communication with the ICH 924. The ICH 924 can provide suitable arbitration and buffering for each interface.

For one embodiment, the ICH 924 provides an interface to the one or more IDE drives 908, such as a hard disk drive (HDD) or compact disc read only memory (CD ROM) drive, or to suitable universal serial bus (USB) devices through one or more USB ports 910. For one embodiment, the ICH 924 also provides an interface to a keyboard 912, selection device 914 (e.g., a mouse, trackball, touchpad, etc.), CD-ROM drive 918, and one or more suitable devices through one or more firewire ports 916. For one embodiment, the ICH 924 also provides a network interface 920 though which the computer system 900 can communicate with other computers and/or devices.

The computer system 900 may also include a machine-readable storage medium that stores a set of instructions (e.g., software) embodying any one, or all, of the methodologies for modifying three-dimensional, wagering-game content to perspective. Furthermore, software can reside, completely or at least partially, within the memory unit 930 and/or within the processor unit 902. The computer system 900 can also include a 3D gaming module 937. The 3D gaming module 937 can process communications, commands, or other information, to modify three-dimensional, wagering-game content according to changes in perspective, viewing position, etc. Any component of the computer system 900 can be implemented as hardware, firmware, and/or machine-readable storage media including instructions for performing the operations described herein.

Wagering Game Machine Architecture

Figure 10:
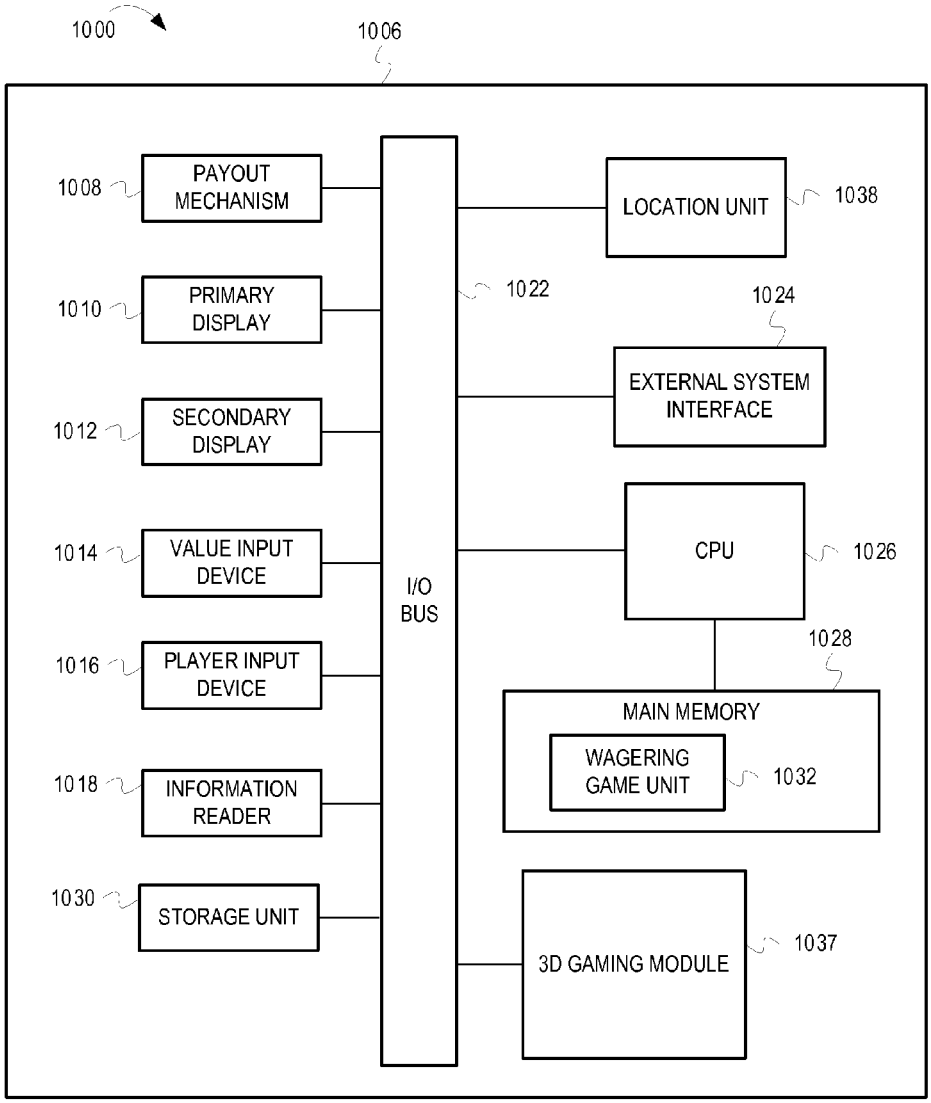
FIG. 10 is an illustration of a wagering game machine architecture 1000, according to some embodiments.

FIG. 10 is a conceptual diagram that illustrates an example of a wagering game machine architecture 1000, according to some embodiments. In FIG. 10, the wagering game machine architecture 1000 includes a wagering game machine 1006, which includes a central processing unit (CPU) 1026 connected to main memory 1028. The CPU 1026 can include any suitable processor, such as an Intel® Pentium processor, Intel® Core 2 Duo processor, AMD Opteron™ processor, or UltraSPARC processor. The main memory 1028 includes a wagering game unit 1032. In some embodiments, the wagering game unit 1032 can present wagering games, such as video poker, video black jack, video slots, video lottery, reel slots, etc., in whole or part.

The CPU 1026 is also connected to an input/output ("I/O") bus 1022, which can include any suitable bus technologies, such as an AGTL+ frontside bus and a PCI backside bus. The I/O bus 1022 is connected to a payout mechanism 1008, primary display 1010, secondary display 1012, value input device 1014, player input device 1016, information reader 1018, and storage unit 1030. The player input device 1016 can include the value input device 1014 to the extent the player input device 1016 is used to place wagers. The I/O bus 1022 is also connected to an external system interface 1024, which is connected to external systems (e.g., wagering game networks). The external system interface 1024 can include logic for exchanging information over wired and wireless networks (e.g., 802.11g transceiver, Bluetooth transceiver, Ethernet transceiver, etc.)

The I/O bus 1022 is also connected to a location unit 1038. The location unit 1038 can create player information that indicates the wagering game machine's location/movements in a casino. In some embodiments, the location unit 1038 includes a global positioning system (GPS) receiver that can determine the wagering game machine's location using GPS satellites. In other embodiments, the location unit 1038 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 10, in some embodiments, the location unit 1038 is not connected to the I/O bus 1022.

In some embodiments, the wagering game machine 1006 can include additional peripheral devices and/or more than one of each component shown in FIG. 10. For example, in some embodiments, the wagering game machine 1006 can include multiple external system interfaces 1024 and/or multiple CPUs 1026. In some embodiments, any of the components can be integrated or subdivided.

In some embodiments, the wagering game machine 1006 includes a 3D gaming module 1037. The 3D gaming module 1037 can process communications, commands, or other information, where the processing can modify three-dimensional, wagering-game content to perspective, viewing position, etc.

Furthermore, any component of the wagering game machine 1006 can include hardware, firmware, and/or machine-readable storage media including instructions for performing the operations described herein.

Wagering Game Machine

Figure 11:
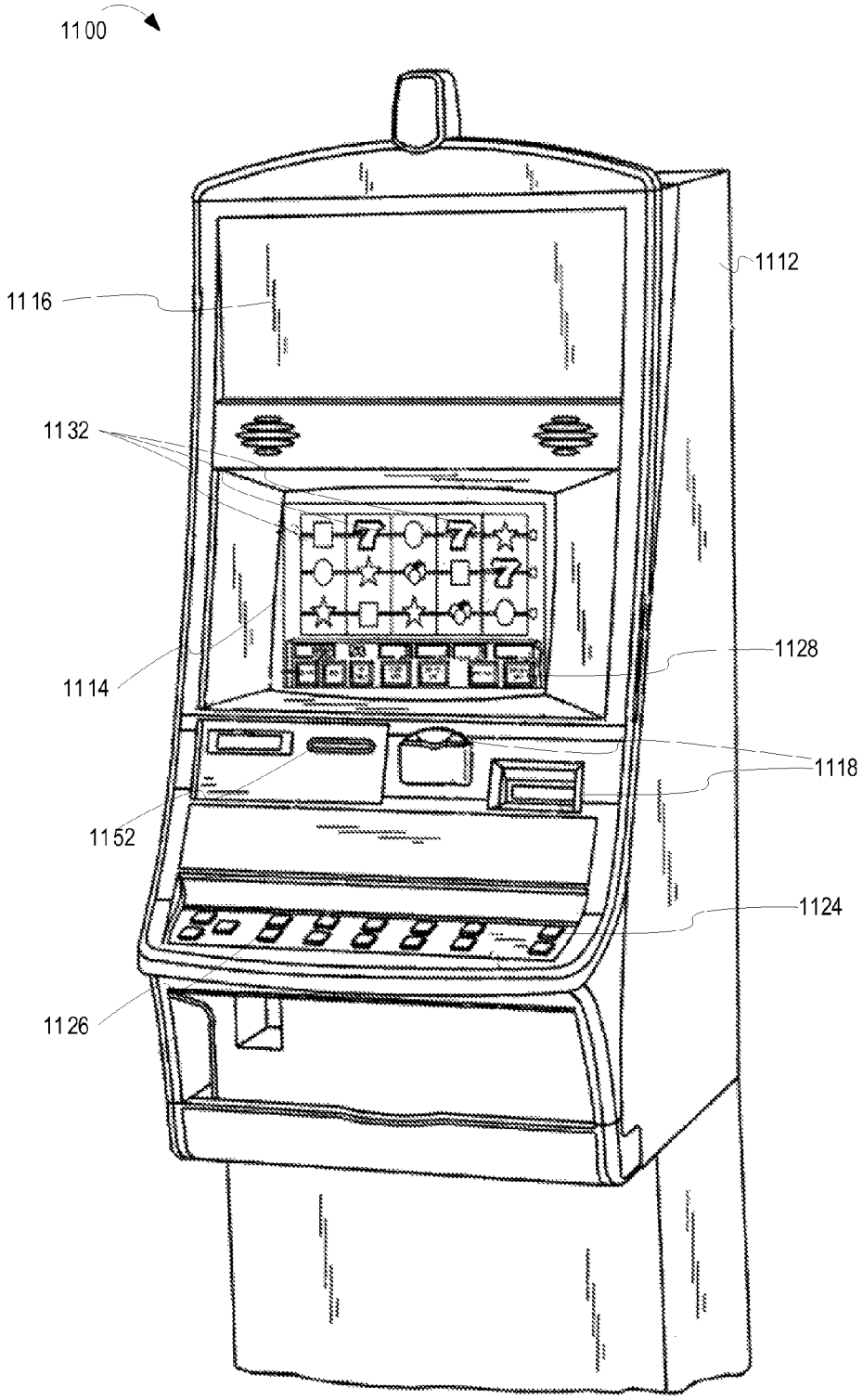
FIG. 11 is an illustration of a wagering game machine 1100, according to some embodiments.

FIG. 11 is a conceptual diagram that illustrates an example of a wagering game machine 1100, according to some embodiments. Referring to FIG. 11, the wagering game machine 1100 can be used in gaming establishments, such as casinos. According to some embodiments, the wagering game machine 1100 can be any type of wagering game machine and can have varying structures and methods of operation. For example, the wagering game machine 1100 can be an electromechanical wagering game machine configured to play mechanical slots, or it can be an electronic wagering game machine configured to play video casino games, such as blackjack, slots, keno, poker, blackjack, roulette, etc.

The wagering game machine 1100 comprises a housing 1112 and includes input devices, including value input devices 1118 and a player input device 1124. For output, the wagering game machine 1100 includes a primary display 1114 for displaying information about a basic wagering game. The primary display 1114 can also display information about a bonus wagering game and a progressive wagering game. The wagering game machine 1100 also includes a secondary display 1116 for displaying wagering game events, wagering game outcomes, and/or signage information. While some components of the wagering game machine 1100 are described herein, numerous other elements can exist and can be used in any number or combination to create varying forms of the wagering game machine 1100.

The value input devices 1118 can take any suitable form and can be located on the front of the housing 1112. The value input devices 1118 can receive currency and/or credits inserted by a player. The value input devices 1118 can include coin acceptors for receiving coin currency and bill acceptors for receiving paper currency. Furthermore, the value input devices 1118 can include ticket readers or barcode scanners for reading information stored on vouchers, cards, or other tangible portable storage devices. The vouchers or cards can authorize access to central accounts, which can transfer money to the wagering game machine 1100.

The player input device 1124 comprises a plurality of push buttons on a button panel 1126 for operating the wagering game machine 1100. In addition, or alternatively, the player input device 1124 can comprise a touch screen 1128 mounted over the primary display 1114 and/or secondary display 1116.

The various components of the wagering game machine 1100 can be connected directly to, or contained within, the housing 1112. Alternatively, some of the wagering game machine's components can be located outside of the housing 1112, while being communicatively coupled with the wagering game machine 1100 using any suitable wired or wireless communication technology.

The operation of the basic wagering game can be displayed to the player on the primary display 1114. The primary display 1114 can also display a bonus game associated with the basic wagering game. The primary display 1114 can include a cathode ray tube (CRT), a high resolution liquid crystal display (LCD), a plasma display, light emitting diodes (LEDs), a 3D display, or any other type of display suitable for use in the wagering game machine 1100. Alternatively, the primary display 1114 can include a number of mechanical reels to display the outcome. In FIG. 11, the wagering game machine 1100 is an "upright" version in which the primary display 1114 is oriented vertically relative to the player. Alternatively, the wagering game machine can be a "slant-top" version in which the primary display 1114 is slanted at about a thirty-degree angle toward the player of the wagering game machine 1100. In yet another embodiment, the wagering game machine 1100 can exhibit any suitable form factor, such as a free standing model, bar top model, mobile handheld model, or workstation console model.

A player begins playing a basic wagering game by making a wager via the value input device 1118. The player can initiate play by using the player input device's buttons or touch screen 1128. The basic game can include arranging a plurality of symbols 1132 along a pay line, which indicates one or more outcomes of the basic game. Such outcomes can be randomly selected in response to player input. At least one of the outcomes, which can include any variation or combination of symbols, can trigger a bonus game.

In some embodiments, the wagering game machine 1100 can also include an information reader 1152, which can include a card reader, ticket reader, bar code scanner, RFID transceiver, or computer readable storage medium interface. In some embodiments, the information reader 1152 can be used to award complimentary services, restore game assets, track player habits, etc.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system to perform a process according to embodiments(s), whether presently described or not, because every conceivable variation is not enumerated herein. A machine-readable storage medium includes any mechanism that stores information in a form readable by a machine (e.g., a wagering game machine, computer, etc.). For example, machine-readable storage media includes read only memory (ROM), random access memory (RAM), magnetic disk storage media, optical storage media (e.g., CD-ROM), flash memory machines, erasable programmable memory (e.g., EPROM and EEPROM); etc. Some embodiments of the invention can also include machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A computer-implemented method comprising:

presenting a three-dimensional image of wagering game content via a display associated with a wagering game machine;

estimating, via at least one of one or more processors, a degree of alteration to a stereoscopic view of the three-dimensional image caused by a change in a lateral position of a chair connected to the wagering game machine; and after estimating the degree of alteration to the stereoscopic view of the three-dimensional image, altering, via at least one of the one or more processors, a presentation of the three-dimensional image based on the degree of alteration to the stereoscopic view of the three-dimensional image caused by the change in the lateral position of the chair.

2. The computer-implemented method of claim 1, wherein the estimating the degree of alteration to the stereoscopic view of the three-dimensional image caused by the change in the lateral position of the chair connected to the wagering game machine comprises:

receiving one or more signals from the chair connected to the wagering game machine, wherein the one or more signals indicate the change in the lateral position of the chair;

estimating a degree of change of a lateral position of an occupant of the chair based on the one or more signals from the chair; and based on the degree of change of the lateral position of the occupant, calculating a degree of parallax shift to apply to the presentation of the three-dimensional image to maintain a stereoscopic effect that appeared via the display prior to the change to the lateral position of the occupant of the chair.

3. The computer-implemented method of claim 2, wherein the altering the presentation of the three-dimensional image further comprises:

based on the degree of parallax shift, modifying the stereoscopic effect of the presentation of the three-dimensional image proportional to the degree of change of the lateral position of the occupant of the chair.

4. The computer-implemented method of claim 3, wherein the modifying the stereoscopic effect of the presentation of the three-dimensional image comprises:

modifying an orientation of an element of the display, at a location of the display associated with the three-dimensional image, proportional to the degree of change of the lateral position of the occupant of the chair.

5. The computer-implemented method of claim 4, wherein the element is one or more of a parallax barrier and a lenticular lens.

6. The computer-implemented method of claim 3, wherein the modifying the stereoscopic effect of the presentation of the three-dimensional image comprises:

modifying a presentation of two sets of pixels, at a location of the display associated with the three-dimensional image, proportional to the degree of change of the lateral position of the occupant of the chair, where the two sets of pixels are associated with two versions of the three-dimensional image which are offset from each other an amount that produces the stereoscopic effect of the three-dimensional image.

7. The computer-implemented method of claim 1, wherein the estimating the degree of alteration to the stereoscopic view of the three-dimensional image caused by the change in the lateral position of the chair connected to the wagering game machine comprises:

detecting an event from the wagering game content, wherein the wagering game content is configured to automatically move the chair in response to the event; and estimating a degree of lateral change in position of the chair based on the event.

8. An apparatus comprising:

a processor; and a wagering game module configured to, via the processor, present a three-dimensional image of wagering game content at a display associated with a wagering game machine, wherein a chair is connected to the wagering game machine, and wherein the chair has a range of motion in a lateral direction, detect a movement of the chair to a limit of the range of motion in the lateral direction, and after detection of the movement of the chair to the limit of the range of motion in the lateral direction, alter a presentation of the three-dimensional image to cause a change in parallax effect to a view of the three-dimensional image beyond what appears to be based on the movement of the chair to the limit of the range of motion in the lateral direction.

9. The apparatus of claim 8, wherein the wagering game module is further configured to, increase a stereoscopic depth effect to the wagering game content a first amount in proportion to a change of viewing perspective of the display in response to the movement of the chair to the limit of the range of motion in the lateral direction, and after the chair moves to the limit of the range of motion in the lateral direction, increase the stereoscopic depth effect a second amount to cause the change in the parallax effect to the view of the three-dimensional image beyond what appears to be based on the movement of the chair to the limit of the range of motion in the lateral direction.

10. The apparatus of claim 8, wherein the wagering game module is further configured to, rotate the presentation of the three-dimensional image in response to the lateral direction of the movement of the chair.

11. The apparatus of claim 8, wherein the wagering game module is further configured to, alter the presentation of the three-dimensional image to change in three-dimensional appearance in agreement with a degree of velocity of the movement of the chair associated with the lateral movement of the chair.

12. The apparatus of claim 8, wherein the wagering game module is further configured to, determine a degree of head motion of an occupant of the chair caused by the movement of the chair, and alter the presentation of the three-dimensional image based on the degree of head motion caused by the movement of the chair.

13. An apparatus comprising:

means for presenting a stereoscopic three-dimensional effect of wagering game content via a display associated with a wagering game machine, wherein the stereoscopic three-dimensional effect is presented based on a position of at least a portion of an observer in relation to the display;

means for detecting machine-generated output by a device associated with one or more of the wagering game machine and the observer, wherein the device is configured to cause a lateral movement of the at least the portion of the observer relative to a perpendicular surface of the display;

means for predicting a change in position of the at least the portion of the observer based on the detecting of the machine-generated output by the device; and means for modifying the stereoscopic three-dimensional effect in response to the predicting the change in position of the at least the portion of the observer based on the detecting of the machine-generated output by the device.

14. The apparatus of claim 13, wherein the at least the portion of the observer are one or more eyes of the observer, wherein the at least the portion of the observer is in contact with the device, and wherein the means for predicting the change in position of the at least the portion of the observer comprises:

means for measuring movement of the device; and means for generating an estimate of a degree of movement of the eyes of the observer based on the measuring of the lateral movement of the device.

15. The apparatus of claim 14, wherein the device is one or more of a treadmill, a sports equipment prop, a rotating apparatus, an enclosure, a pod, a cockpit, a helmet, and a chair.

16. The apparatus of claim 13, wherein the device is configured to emit one or more of a liquid or gas to cause the at least the portion of the observer to move.

17. A system comprising:

one or more processors; and one or more memory devices configured to store instructions which, when executed by at least one of the one or more processors, cause the system to perform operations to provide, for presentation via a display associated with a wagering game machine, a three-dimensional image of wagering game content;

estimate a degree of alteration to a stereoscopic view of the three-dimensional image caused by a change in a lateral position of a chair connected to the wagering game machine, and after estimating the degree of alteration to the stereoscopic view of the three-dimensional image, alter a presentation of the three-dimensional image based on the estimated degree of alteration to the stereoscopic view of the three-dimensional image caused by the change in the lateral position of the chair.

18. The system of claim 17, wherein the instructions which, when executed by at least one of the one or more processors, cause the system to perform the operation to estimate the degree of alteration to the stereoscopic view of the three-dimensional image caused by the change in the lateral position of the chair connected to the wagering game machine include instructions which, when executed by at least one of the one or more processors, cause the system to perform operations to:

receive one or more signals from the chair connected to the wagering game machine;

estimate a degree of change of lateral position of an occupant of the chair based on the one or more signals from the chair; and calculate a degree of modification that would be required to apply to the presentation of the three-dimensional image to maintain a stereoscopic effect presented via the display prior to the change of the lateral position of the occupant of the chair.

19. The system of claim 18, wherein the instructions which, when executed by at least one of the one or more processors, cause the system to perform the operation to alter the presentation of the three-dimensional image includes one or more instructions which, when executed by at least one of the one or more processors, cause the system to perform one or more operations to:

modify a stereoscopic effect of the presentation of the three-dimensional image proportional to the degree of change of the lateral position of the occupant of the chair.

20. The system of claim 19, wherein the instructions which, when executed by at least one of the one or more processors, cause the system to perform the operation to modify the stereoscopic effect of the presentation of the three-dimensional image includes one or more instructions which, when executed by at least one of the one or more processors, cause the system to perform one or more operations to:

modify an orientation of an element of the display, at a location of the display associated with the three-dimensional image, proportional to the degree of change of the lateral position of the occupant of the chair.

21. The system of claim 20, wherein the element is one or more of a parallax barrier and a lenticular lens.

22. One or more non-transitory machine-readable storage media having instructions stored thereon, which when executed by a set of one or more processors cause the set of one or more processors to perform operations comprising:

providing, for presentation via a display associated with a wagering game machine, a three-dimensional image of wagering game content;

estimating a degree of alteration to a stereoscopic view of the three-dimensional image caused by a change in a lateral position of a chair connected to the wagering game machine; and after estimating the degree of alteration to the stereoscopic view of the three-dimensional image, altering a presentation of the three-dimensional image based on the degree of alteration to the stereoscopic view of the three-dimensional image caused by the change in the lateral position of the chair.

23. The one or more machine-readable media of claim 22, wherein the operation of estimating the degree of alteration to the stereoscopic view of the three-dimensional image caused by the change in the lateral position of the chair connected to the wagering game machine includes operations comprising:

detecting an event from the wagering game content, wherein the wagering game content is configured to automatically move the chair in response to the event;

estimating a degree of lateral change in the lateral position of the chair based on the event; and calculating a degree of modification that would be required to apply to the presentation of the three-dimensional image to maintain a stereoscopic effect presented via the display from a viewing angle associated with the chair prior to the change of the lateral position of the chair.

24. The one or more machine-readable media of claim 23, wherein the operation of altering the presentation of the three-dimensional image includes an operation comprising:

modifying the stereoscopic effect of the presentation of the three-dimensional image proportional to the degree of change of the lateral position of the chair.

25. The one or more machine-readable media of claim 24, wherein the operation of modifying the stereoscopic effect of the presentation of the three-dimensional image comprises:

modifying a presentation of two sets of pixels, at a location of the display associated with the three-dimensional image, proportional to the degree of change of the lateral position of the chair, wherein the two sets of pixels are associated with two versions of the three-dimensional image which are offset from each other an amount that produces the stereoscopic effect of the three-dimensional image.

* * * * *